US008705749B2

(12) United States Patent
McGrath et al.

(10) Patent No.: US 8,705,749 B2
(45) Date of Patent: Apr. 22, 2014

(54) AUDIO SIGNAL TRANSFORMATTING

(75) Inventors: David S McGrath, Rose Bay (AU); Glenn N Dickins, Jerrabomberra (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 626 days.

(21) Appl. No.: 13/058,617

(22) PCT Filed: Aug. 13, 2009

(86) PCT No.: PCT/US2009/053664
§ 371 (c)(1),
(2), (4) Date: Feb. 11, 2011

(87) PCT Pub. No.: WO2010/019750
PCT Pub. Date: Feb. 18, 2010

(65) Prior Publication Data

US 2011/0137662 A1 Jun. 9, 2011

Related U.S. Application Data

(60) Provisional application No. 61/189,087, filed on Aug. 14, 2008.

(51) Int. Cl.
*H04R 5/00* (2006.01)

(52) U.S. Cl.
USPC ..... 381/20; 381/17; 381/18; 381/19

(58) Field of Classification Search
USPC ..... 381/17–20
See application file for complete search history.

(56) References Cited

U.S. PATENT DOCUMENTS

| | | | | |
|---|---|---|---|---|
| 4,799,260 | A | 1/1989 | Mandell | |
| 4,941,177 | A | 7/1990 | Mandell | |
| 5,046,098 | A | 9/1991 | Mandell | |
| 6,920,223 | B1 | 7/2005 | Fosgate | |
| 7,280,664 | B2 | 10/2007 | Fosgate | |
| 7,660,424 | B2 * | 2/2010 | Davis | 381/20 |
| 2007/0140498 | A1 * | 6/2007 | Moon et al. | 381/20 |
| 2007/0291950 | A1 * | 12/2007 | Kimura et al. | 381/20 |

FOREIGN PATENT DOCUMENTS

WO 2007111568 10/2007

OTHER PUBLICATIONS

Avendano, et al., "Frequency Domain Techniques for Stereo to Multichannel Upmix" AES International Conference on Virtual, Synthetic and Entertainment Audio, Jun. 1, 2002, pp. 1-10.
Faller, Christof, "Matrix Surround Revisited" AES 30th International Conference, Mar. 15, 2007, pp. 1-7.

* cited by examiner

*Primary Examiner* — Shaun Roberts

(57) ABSTRACT

This invention relates to reformatting a plurality of audio input signals from a first format to a second format by applying them to a dynamically-varying transformatting matrix. In particular, this invention obtains information attributable to the direction and intensity of one or more directional signal components, calculates the transformatting matrix based on the first and second rules, and applies the audio input signals to the transformatting matrix to produce output signals.

21 Claims, 10 Drawing Sheets

AUDIO SIGNAL TRANSFORMATTING

CROSS-REFERENCE TO RELATED APPLICATIONS

This application claims priority to U.S. Patent Provisional Application No. 61/189,087, filed 14 Aug. 2008, hereby incorporated by reference in its entirety.

BACKGROUND OF THE INVENTION

Field of the Invention

The invention relates generally to audio signal processing. In particular, the invention relates to methods for reformatting a plurality of audio input signals from a first format to a second format by applying them to a dynamically-varying transformatting matrix. The invention also relates to apparatus and computer programs for performing such methods.

SUMMARY OF THE INVENTION

In accordance with aspects of the present invention, a method for reformatting a plurality [NI] of audio input signals [$\text{Input}_1(t)$] from a first format to a second format by applying them to a dynamically-varying transformatting matrix [M], in which the plurality of notional source signals [$\text{Source}_1(t) \ldots \text{Source}_{NS}(t)$], each associated with information about itself, to an encoding matrix [I], the encoding matrix processing the notional source signals in accordance with a first rule that processes each notional source signal in accordance with the notional information associated with it, the transformatting matrix being controlled so that differences are reduced between a plurality [NO] of output signals [$\text{Output}_1(t) \ldots \text{Output}_{NO}(t)$] produced by it and plurality [NO] of notional ideal output signals [$\text{IdealOut}_1(t) \ldots \text{IdealOut}_{NO}(t)$] assumed to have been derived by applying the notional source signals to an ideal decoding matrix [O], the decoding matrix processing the notional source signals in accordance with a second rule that processes each notional source signal in accordance with the notional information associated with it, comprises obtaining, in response to the audio input signals in each of a plurality of frequency and time segments, information attributable to the direction and intensity of a diffuse, non-directional signal component, calculating the transformatting matrix based on the first and second rules, the calculating including (a) estimating (i) a covariance matrix of the audio input signals in at least one of the plurality of frequency and time segments and (ii) a cross-covariance matrix of the audio input signals and the notional ideal output signals in the same at least one of the plurality of frequency and time segments, (i) the directions and intensities of directional signal components and (ii) the intensities of diffuse, non-directional signal components, and applying the audio input signals to the transformatting matrix to produce the output signals.

The transformatting matrix characteristics may be calculated as a function of the covariance matrix and the cross-covariance matrix. The elements of the transformatting matrix [M] may be obtained by operating on the cross-covariance matrix from the right by the inverse of the covariance matrix, $$M=\text{Cov}([\text{IdealOutput}],\ [\text{Input}])\ \{\text{Cov}([\text{Input}],\ [\text{Input}]\}^{-1}$$

The plurality of notional source signals may be assumed to be mutually uncorrelated with respect to each other, whereby a covariance matrix of the notional source signals, the calculation of which is inherent in the calculation of M, is diagonalized, thereby simplifying the calculations. The decoder matrix [M] may be determined by a method of steepest descent. The method of steepest descent may be a gradient descent method that computes an iterated estimate of the transformatting matrix based on a previous estimate of M a prior time interval.

In accordance with aspects of the present invention, a method for reformatting a plurality [NI] of audio input signals [$\text{Input}_1(t) \ldots \text{input}_{NI}(t)$] from a first format to a second format by applying them to a dynamically-varying transformatting matrix [M], in which the plurality of audio input signals are assumed to have been derived by applying a plurality of notional source signals S=[$\text{Source}_1(t) \ldots \text{Source}_{NS}(t)$], each assumed to be mutually uncorrelated with one another and each associated with information about itself, to an encoding matrix [I], the encoding matrix processing the notional source signals in accordance with a first rule that processes each notional source signal in accordance with the notional information associated with it, the transformatting matrix being controlled so that differences are reduced between a plurality [NO] of output signals [$\text{Output}_1(t) \ldots \text{Output}_{NO}(t)$] produced by it and a plurality [NO] of notional ideal output signals [$\text{IdealOut}_1(t) \ldots \text{IdealOut}_{NO}(t)$] assumed to have been derived by applying to the notional source signals to an ideal decoding matrix [O], the decoding matrix processing the notional source signals in accordance with a second rule that processes each notional source signal in accordance with the notional information associated with it, comprises obtaining in response to the audio input signals in each of a plurality of frequency and time segments, information attributable to the direction and intensity of one or more directional signal components and to the intensity of a diffuse, non-directional signal component, calculating the transformatting matrix M, the calculating including (a) combining, in a plurality of the frequency and time segments, (i) the directions and intensities of directional signal components and (ii) the intensities of diffuse, non-directional signal components, the result of the combining constituting an estimate of a covariance matrix of the source signals [$S \times S^*$], (b) calculating $\text{ISSI}=I \times (S \times S^*) \times I^*$ and $\text{OSSI}=O \times (S \times S^*) \times I^*$, and (c) calculating $M=(\text{OSSI}) \times (\text{ISSI})^{-1}$, and applying the audio input signals to the transformatting matrix to produce the output signals.

The notional information may comprise an index and the processing in accordance with a first rule associated with a particular index may be paired with the processing in accordance with a second rule associated with the same index. 19. The first and second rules may be implemented as first and second lookup tables, table entries being paired with one another by a common index.

The notional information may be notional directional information. Notional directional information may be notional three-dimensional directional information. Notional three-dimensional information may include a notional azimuthal and elevation relationship with respect to a notional listening position. Notional directional information may be notional two-dimensional directional information. Notional two-dimensional directional information may include a notional azimuthal relationship with respect to a notional listening position.

The first rules may be input panning rules and the second rules may be output panning rules.

Obtaining, in response to the audio input signals in each of a plurality of frequency and time segments, information attributable to the direction and intensity of one or more directional signal components and to the intensity of a diffuse, non-directional signal component, may include calculating a covariance matrix of the audio input signals in the each of the plurality of frequency and time segments. The direction and intensity of one or more directional signal components and intensity of a diffuse, non-directional signal component for each frequency and time segment may be estimated, based on the results of the covariance matrix calculation. The estimate of the diffuse, non-directional signal component for each frequency and time segment may be formed from the value of the smallest eigenvalue in the covariance matrix calculation.

The transformatting matrix may be a variable matrix having variable coefficients or a variable matrix having fixed coefficients and variable outputs, and the transformatting matrix may be controlled by varying the variable coefficients or by varying the variable outputs.

The decoder matrix [M] may be a weighted sum of frequency-dependent decoder matrices $[M_B]$, $M=\Sigma_B W_B M_B$, wherein the frequency dependence is associated with a bandwidth B.

Aspects of the present invention also include apparatus adapted to practice any of the above methods.

Aspects of the present invention further include computer programs adapted to implement any of the above methods.

DETAILED DESCRIPTION OF THE INVENTION

Figure 1:
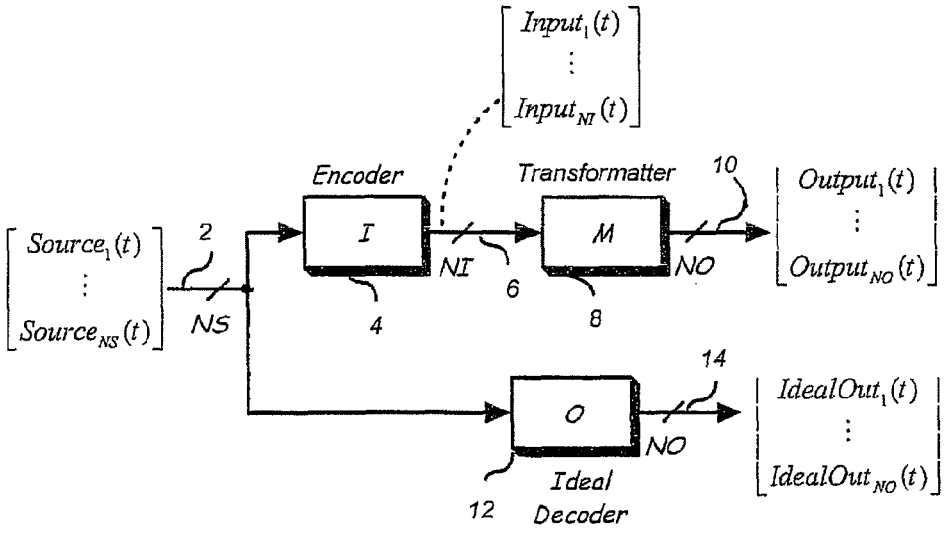
FIG. 1 is a functional block diagram useful in explaining aspects of a transformatter according to the present invention and the manner in which such a transformatter may be identified.

According to aspects of the present invention, a transformatting process or device (a trans formatter) receives a plurality of audio input signals and reformats them from a first format to a second format. For clarity in presentation, the process and device are variously referred to herein as a "transformatter." The transformatter may be a dynamically-varying transformatting matrix or matrixing process (for example, a linear matrix or linear matrixing process). Such a matrix or matrixing process is often referred to in the art as an "active matrix" or "adaptive matrix."

Although, in principle, aspects of the present invention may be practiced in the analog domain or the digital domain (or some combination of the two), in practical embodiments of the invention, audio signals are represented by time samples in blocks of data and processing is done in the digital domain. Each of the various audio signals may be time samples that may have been derived from analog audio signals or which are to be converted to analog audio signals. The various time-sampled signals may be encoded in any suitable manner or manners, such as in the form of linear pulse-code modulation (PCM) signals, for example.

An example of a first format is a pair of stereophonic audio signals (often referred to as the Lt (left total) and Rt (right total) channels) that are the result of, or are assumed to be the result of, matrix encoding five discrete audio signals or "channels," each notionally associated with an azimuthal direction with respect to a listener such as left ("L"), center ("C"), right ("R"), left surround ("LS") and right surround ("RS"). An audio signal notionally associated with a spatial direction is often referred to as a "channel." Such matrix encoding may have been accomplished by a passive matrix encoder that maps five directional channels to two directional channels in accordance with defined panning rules, such as, for example, an MP matrix encoder or a ProLogic II matrix encoder, each of which is well-known in the art. The details of such an encoder are not critical or necessary to the present invention.

An example of a second format is a set of five audio signals or channels each notionally associated with an azimuthal direction with respect to a listener such as the above-mentioned left ("L"), center ("C"), right ("R"), left surround ("LS") and right surround ("RS") channels. Typically, it is assumed that such signals are reproduced in such as way as to provide to a suitably-located listener the impression that each channel, if energized in isolation, is arriving from the direction with which it is associated.

Although an exemplary transformatter is described herein having two input channels, such as described above, and five output channels, such as described above, a transformatter according to the present invention may have other than two input channels and other than five output channels. The number of input channels may be more or less than the number of output channels or the number of each may be equal. Transformations in formatting provided by a transformatter according to the present invention may involve not only the number of channels but also changes in the notional directions of the channels.

One useful way to describe a transformatter according to aspects of the present invention is in an environment such as that of FIG. 1. Referring to FIG. 1, a plurality (NS) of notional audio source signals ($\text{Source}_1(t) \ldots \text{Source}_{NS}(f)$), which may be represented by a vector "S," is assumed to be received on line 2. S may be defined as $$S = \begin{bmatrix} Source_1(t) \\ \vdots \\ Source_{NS}(t) \end{bmatrix}, \tag{1.1}$$

in which $\text{Source}_1(t)$ through $\text{Source}_{NS}(t)$ are the NS notional audio source signals or signal components. The notional audio source signals are notional (they may or may not exist or have existed) and are not known in calculating the transformatter matrix. However, as explained herein, estimates of certain attributes of the notional source signals are useful to aspects of the present invention.

One may assume that there are a fixed number of notional source signals. For example, one may assume that there are twelve input sources (as in an example below), or one may assume that there are 360 source signals (spaced, for example, at one-degree increments in azimuth one a horizontal plane around a listener), it being understood that there may be any number (NS) of sources. Associated with each audio source signal is information about itself, such as its azimuth or azimuth and elevation with respect to a notional listener. See the example of FIG. 2, described below.

For clarity in presentation, throughout this document, lines carrying multiple signals (or a vector having multiple signal components) are shown as single lines. In practical hardware embodiments, and analogously in software embodiments, such lines may be implemented as multiple physical lines or as one or more physical lines on which signals are carried in multiplexed form.

Returning to the description of FIG. 1, the notional audio source signals are applied to two paths. In a first path, the upper path shown in FIG. 1, the notional audio source signals are applied to an "I" encoder or encoding process ("Encoder") 4. As explained further below, the I Encoder 4 may be a static (time-invariant) encoding matrix process or matrix encoder (for example, a linear mixing process or linear mixer) I operating in accordance with a set of first rules. The rules may cause the I encoder matrix to process each notional source signal in accordance with the notional information associated with it. For example, if a direction is associated with a source signal, the source signal may be encoded in accordance with panning rules or coefficients associated with that direction. An example of a first set of rules is the Input Panning Rules described below.

The I Encoder 4 puts out, in response to the NS source signals applied to it, a plurality (NI) of audio signals that are applied to a transformatter as audio input signals ($\text{Input}_1(t) \ldots \text{Input}_{NI}(t)$) on line 6. The NS audio input signals may be represented by a vector "Input," which may be defined as $$\text{Input} = \begin{bmatrix} Input_1(t) \\ \vdots \\ Input_{NI}(t) \end{bmatrix} = I \times S, \tag{1.2}$$

in which $\text{Input}_1(t)$ through $\text{Input}_{NI}(t)$ are the NI audio input signals or signal components.

The NI audio input signals are applied to a transformatting process or transformatter (Transformatter M) 8. As explained further below, Transformatter M may be a controllable dynamically-varying transformatting matrix or matrixing process. Control of the transformatter is not shown in FIG. 1. Control of the Transformatter M is explained below, initially in connection with FIG. 6. Transformatter M outputs on line 10 a plurality (NO) of output signals ($\text{Output}_1(t) \ldots \text{Output}_{NO}(t)$), which may be represented by a vector "Output," which, in turn, may be defined as $$\text{Output} = \begin{bmatrix} Output_1(t) \\ \vdots \\ Output_{NO}(t) \end{bmatrix} = M \times \text{Input} = M \times I \times S, \tag{1.3}$$

in which $\text{Output}_1(t)$ through $\text{Output}_{NO}(t)$ are the NO audio output signals or signal components.

As mentioned above, the notional audio source signals ($\text{Source}_1(t) \ldots \text{Source}_{NS}(f)$) are applied to two paths. In the second path, the lower path shown in FIG. 1, the notional audio source signals are applied to an encoder or encoding process ("Ideal Decoder 'O'") 10. As explained further below, Ideal Decoder O may be a static (time-invariant) decoding matrix process or matrix decoder (for example, a linear mixing process or linear mixer) O, operating in accordance with a second rule. The rule may cause the decoder matrix O to process each notional source signal in accordance with the notional information associated with it. For example, if a direction is associated with a source signal, the source signal may be decoded in accordance with panning coefficients associated with that direction. An example of a second rule is the Output Panning Rules described below.

The Ideal Decoder outputs on line 14 a plurality (NO) of ideal output signals ($\text{IdealOut}_1(t) \ldots \text{IdealOut}_{NO}(t)$), which may be represented by a vector "Ideal Out," which, in turn, may be defined as $$IdealOut = \begin{bmatrix} IdealOut_1(t) \\ \vdots \\ IdealOut_{NO}(t) \end{bmatrix} O \times S. \quad (1.4)$$

in which $IdealOut_1(t)$ through $IdealOut_{NO}(t)$ are the NO ideal output signals or signal components.

Figure 2:
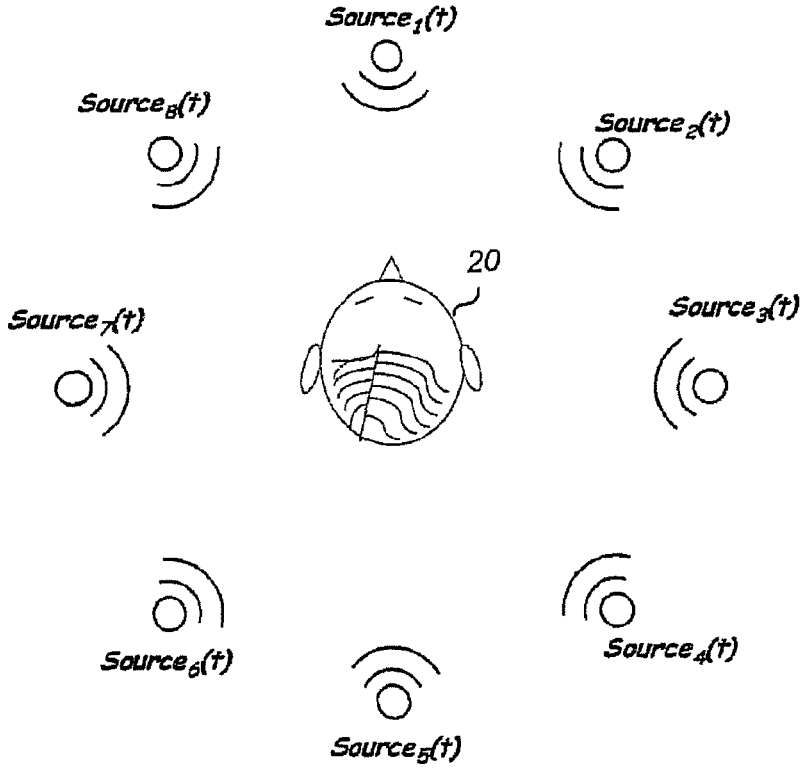
FIG. 2 is an example of multiple audio sources distributed around a listener.

It may be useful to assume that a Transformatter M in accordance with aspects of the present invention is employed so as to provide for a listener an experience that approximates, as closely as possible, the situation illustrated in FIG. 2, in which there are a number of discrete virtual sound sources positioned around a listener 20. In the example of FIG. 2, there are eight sound sources, it being understood that there may be any number (NS) of sources, as mentioned above. Associated with each sound source is information about itself, such as its azimuth or azimuth and elevation with respect to a notional listener.

In principle, a Transformatter M operating in accordance with aspects of the present invention may provide a perfect result (a perfect match Output to IdealOut) when the Input represents no more than NI discrete sources. For example, in the case of two Input signals (NI=2) derived from two Source signals, each panned to a different azimuth angle, for many signal conditions, the Transformatter M may be capable of separating the two sources and panning them to their appropriate directions in its Output channels.

As mentioned above, the input source signals, $Source_1(t)$, $Source_2(t)$, . . . $Source_{NS}(t)$, are notional and are not known. Instead, what is known is the smaller set of input signals (NI) that have been mixed down from the NS source signals by matrix encoder I. It is assumed that the creation of these input signals was carried out by using a known static mixing matrix, I (an NI×NS matrix). Matrix I may contain complex values, if necessary, to indicate phase shifts applied in the mixing process.

It is assumed that the output signals from the Transformatter M drives or is intended to drive a set of loudspeakers, the number of which is known and which loudspeakers are not necessarily positioned in angular locations corresponding to original source signal directions. The goal of the Transformatter M is to take its input signals and create output signals that, when applied to the loudspeakers, provide a listener with an experience that emulates, as closely as possible, a scenario such as in the example of FIG. 2.

If one assumes that one has been provided with the original source signals, $Source_1N$, $Source_2(t)$, . . . , $Source_{NS}(t)$, one may then postulate that there is an optimal mixing process that generates "ideal" loudspeaker signals. The Ideal Decoder matrix O (an NO×NS matrix) mixes the source signals to create such ideal speaker feeds. It is assumed that both the output signals from the Transformatter M and the ideal output signals from the Ideal Decoder matrix O are feeding or are intended to feed the same set of loudspeakers arranged in the same way vis-à-vis one or more listeners.

Transformatter M is provided with NI input signals. It generates NO output signals using a linear matrix-mixer, M (where M may be time-varying). M is a NO×NI matrix. A goal of the Transformatter is to generate outputs that match, as closely as possible, the outputs of the Ideal Decoder (but the Ideal Output signals are not known). However, the Transformatter does know the coefficients of the I and O matrix mixers (as may be obtained, for example, from Input and Output Panning Tables as described below), and it may use this knowledge to guide it in determining its mixing characteristics. Of course, an "Ideal Decoder" is not a practical part of a Transformatter, but it is shown in FIG. 1 because its output is used to compare theoretically with the performance of the Transformatter, as explained below.

Although the number of inputs and outputs (NI and NO) to and from Transformatter M may be fixed for a given transformatter, the number of input sources is generally unknown, and one, quite valid, approach is to "guess" that the number of sources, NS, is large (such as NS=360). In general, there may be some loss of accuracy in the Transformatter if NS is chosen to be too small, so the ideal value for NS involves a trade-off between accuracy versus efficiency. A choice of NS=360 may be useful to remind the reader that (a) the number of sources preferably should be large, and, typically, (b) the sources span 360-degrees on a horizontal plane around a listener. In a practical system, NS may be chosen to be much smaller (such as NS=12, as in the examples below), or it may be possible for some implementations to operate in a manner that treats the source audio as a continuous function of angle, rather than being quantized to fixed angular positions (as if NS=∞).

Panning Tables may be employed to express Input Panning Rules and Output Panning Rules. Such panning tables may be arranged so that, for example, the rows of the table correspond to a sound source azimuth angle. Equivalently, panning rules may be defined in the form of input-to-output reformatting rules having paired entries, without reference to any specific sound-source azimuth.

One may define a pair of lookup tables, both having the same number of entries, the first being an Input Panning Table, and the second being an Output Panning Table. For example, Table 1, below, shows an Input Panning Table for a matrix encoder, where the twelve rows in the table correspond to twelve possible input-panning scenarios (in this case, they correspond to twelve azimuth angles for a horizontal surround sound reproduction system). Table 2, below, shows an Output Panning Table that indicates the desired output-panning rules for the same twelve scenarios. The Input Panning Table and the Output Panning Table may have the same number of rows so that each row of the Input Panning Table may be paired with the corresponding row in the Output Panning Table.

Although in examples herein, reference is made to panning tables, it is also possible to characterize them as panning functions. The main difference is that panning tables are used by addressing a row of the table with an index, which is a whole number, whereas panning functions are indexed by a continuous input (such as azimuth angle). A panning function operates much like an infinite-sized panning table, which must rely on some kind of algorithmic calculation of panning values (for example, sin( ) and cos( ) functions in the case of matrix-encoded inputs).

Each row of a panning table may correspond to a scenario. The total number of scenarios, which is also equal to the number of rows in the table, is NS. In examples herein, NS=12. In general, one may join the Input and Output panning tables into a combined Input-Output Panning Table, as shown below in Table 3.

Figure 3:
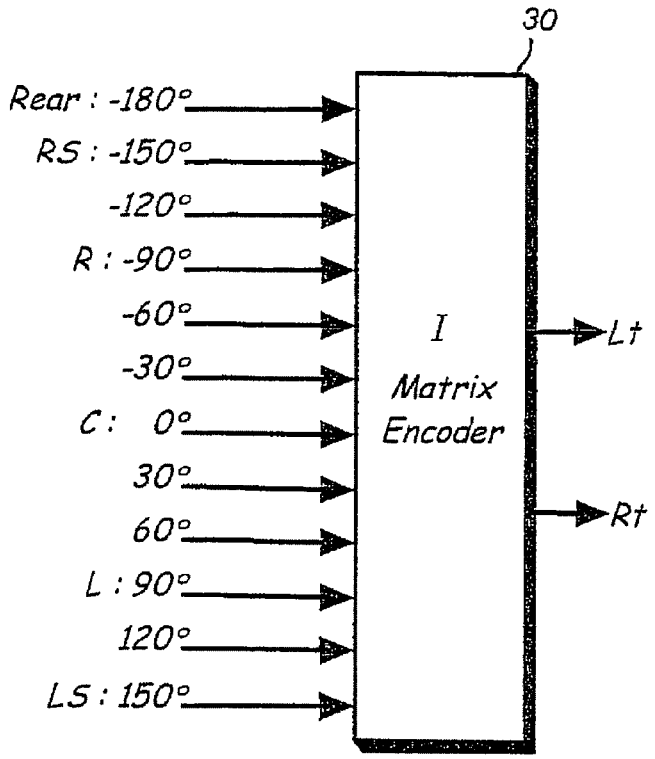
FIG. 3 is an example of an "I" matrix encoder such as may be employed to define a set of rules relating to the input of a transformatter according to the present invention.

FIG. 3 shows an example of an I Encoder 4, a 12-input, 2-output matrix encoder 30. Such a matrix encoder may be considered as a super-set of a conventional 5-input, 2-output (Lt and Rt) encoder having RS (right surround), R (right), C (center), L (left), and LS (left surround) inputs. Nominal angle-of-arrival azimuth values may be associated with each of the 12 input channels (scenarios), as shown below in Table 1. Gain values in this example were chosen to correspond to the cosines of simple angles, to simplify subsequent mathematics. Other values may be used. The particular gain values are not critical to the invention.

TABLE 1

Input Panning Table

| Scenario | Azimuth Angle (θ) | Corresponding 5 channel input | Gain to Lt output | Gain to Rt Output |
|---|---|---|---|---|
| 1 | −180 | | cos(−135°) | cos(−45°) |
| 2 | −150 | RS | cos(−120°) | cos(−30°) |
| 3 | −120 | | cos(−105°) | cos(−15°) |
| 4 | −90 | R | cos(−90°) | cos(0°) |
| 5 | −60 | | cos(−75°) | cos(15°) |
| 6 | −30 | | cos(−60°) | cos(30°) |
| 7 | 0 | C | cos(−45°) | cos(45°) |
| 8 | 30 | | cos(−30°) | cos(60°) |
| 9 | 60 | | cos(−15°) | cos(75°) |
| 10 | 90 | L | cos(0°) | cos(90°) |
| 11 | 120 | | cos(15°) | cos(105°) |
| 12 | 150 | LS | cos(30°) | cos(120°) |

Hence, according to this example, the input panning matrix, I, is a 2×12 matrix, and is defined as follows:

$$I = \begin{bmatrix} G_{Lt,-180} & G_{Lt,-150} & \dots & G_{Lt,150} \\ G_{Rt,-180} & G_{Rt,-150} & \dots & G_{Rt,150} \end{bmatrix} \quad 1.1$$

$$= \begin{bmatrix} \cos(-135°) & \cos(-120°) & \dots & \cos(30°) \\ \cos(-45°) & \cos(-30°) & \dots & \cos(120°) \end{bmatrix}$$

$$= \begin{bmatrix} -0.707 & -0.5 & -0.259 & 0 & 0.259 & 0.500 & 0.707 & 0.866 & 0.966 & 1 & 0.966 & 0.866 \\ 0.707 & 0.866 & 0.966 & 1 & 0.966 & 0.866 & 0.707 & 0.500 & 0.259 & 0 & -0.259 & -0.5 \end{bmatrix}$$

Where:

$$G_{Lt,\theta} = \cos\left(\frac{\theta - 90°}{2}\right) \quad 1.2$$

$$G_{Rt,\theta} = \cos\left(\frac{\theta + 90°}{2}\right)$$

These gain values adhere to the commonly accepted rules for matrix encoding:

1) When a signal is panned to 90° (to the left), the gain to the Left channel should be 1.0, and the gain to the right channel should be 0.0;
2) When a signal is panned to −90° (to the right), the gain to the Left channel should be 0.0, and the gain to the right channel should be 1.0;
3) When a signal is panned to 0° (to the center), the gain to the Left channel should be $1/\sqrt{2}$, and the gain to the right channel should be $1/\sqrt{2}$;
4) When a signal is panned to 180° (to the rear), the left and right channel gains should be out-of-phase; and
5) Regardless of the angle, θ, the squares of the two gain values should sum to 1.0: $(G_{Lt,\theta})^2+(G_{Rt,\theta})^2=1$.

Figure 4:
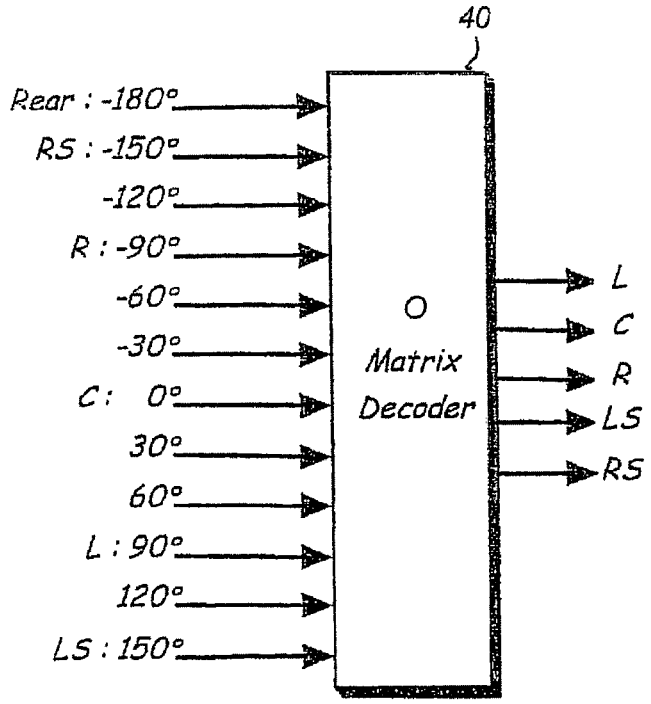
FIG. 4 is an example of an "O" matrix decoder such as may be employed to define a set of rules relating to an ideal output of a transformatter according to the present invention.

FIG. 4 shows an example of an O Ideal Decoder 12, a 12-input, 5-output matrix decoder 40. The outputs are intended for five loudspeakers located, respectively, at the nominal directions indicated with respect to a listener. Nominal angle-of-arrival values may be associated with each of the 12 input channels (scenarios), as shown below in Table 2. Gain values in this example were chosen to correspond to the cosines of simple angles, to simplify subsequent mathematics. Other values may be used. The particular gain values are not critical to the invention.

TABLE 2

Output Panning Table

| Scenario | Azimuth Angle (θ) | Corresponding 5 channel input | Gain to L output | Gain to C output | Gain to R output | Gain to LS output | Gain to RS output |
|---|---|---|---|---|---|---|---|
| 1 | −180 | | 0 | 0 | 0 | −0.5 | 0.5 |
| 2 | −150 | RS | 0 | 0 | 0 | 0 | 1 |
| 3 | −120 | | 0 | 0 | 0.5 | 0 | 0.5 |
| 4 | −90 | R | 0 | 0 | 1 | 0 | 0 |
| 5 | −60 | | 0 | 0.333 | 0.666 | 0 | 0 |
| 6 | −30 | | 0 | 0.666 | 0.333 | 0 | 0 |
| 7 | 0 | C | 0 | 1 | 0 | 0 | 0 |
| 8 | 30 | | 0.333 | 0.666 | 0 | 0 | 0 |
| 9 | 60 | | 0.666 | 0.333 | 0 | 0 | 0 |
| 10 | 90 | L | 1 | 0 | 0 | 0 | 0 |
| 11 | 120 | | 0.5 | 0 | 0 | 0.5 | 0 |
| 12 | 150 | LS | 0 | 0 | 0 | 1 | 0 |

The panning coefficients in Table 2 effectively define an exemplary O matrix, namely $$O = \begin{bmatrix} 0 & 0 & 0 & 0 & 0 & 0 & 0 & \frac{1}{3} & \frac{2}{3} & 1 & \frac{1}{2} & 0 \\ 0 & 0 & 0 & 0 & \frac{1}{3} & \frac{2}{3} & 1 & \frac{2}{3} & \frac{1}{3} & 0 & 0 & 0 \\ 0 & 0 & \frac{1}{2} & 1 & \frac{2}{3} & \frac{1}{3} & 0 & 0 & 0 & 0 & 0 & 0 \\ -\frac{1}{2} & 0 & 0 & 0 & 0 & 0 & 0 & 0 & 0 & 0 & \frac{1}{2} & 1 \\ \frac{1}{2} & 1 & \frac{1}{2} & 0 & 0 & 0 & 0 & 0 & 0 & 0 & 0 & 0 \end{bmatrix} \quad 1.3$$

Alternatively, a constant-power output panning matrix is given in Equation 1.4:

$$O = \begin{bmatrix} 0 & 0 & 0 & 0 & 0 & 0 & 0 & \sqrt{\frac{1}{3}} & \sqrt{\frac{2}{3}} & 1 & \sqrt{\frac{1}{2}} & 0 \\ 0 & 0 & 0 & 0 & \sqrt{\frac{1}{3}} & \sqrt{\frac{2}{3}} & 1 & \sqrt{\frac{2}{3}} & \sqrt{\frac{1}{3}} & 0 & 0 & 0 \\ 0 & 0 & \sqrt{\frac{1}{2}} & 1 & \sqrt{\frac{2}{3}} & \sqrt{\frac{1}{3}} & 0 & 0 & 0 & 0 & 0 & 0 \\ -\sqrt{\frac{1}{2}} & 0 & 0 & 0 & 0 & 0 & 0 & 0 & 0 & 0 & \sqrt{\frac{1}{2}} & 1 \\ \sqrt{\frac{1}{2}} & 1 & \sqrt{\frac{1}{2}} & 0 & 0 & 0 & 0 & 0 & 0 & 0 & 0 & 0 \end{bmatrix} \quad 1.4$$

A constant-power panning matrix has the property that the squares of the panning gains in each column of the O matrix sum to one. While the input encoding matrix, I, is typically a pre-defined matrix, the output mixing matrix, O, may be "hand-crafted" to some degree, allowing some modification of the panning rules. A panning matrix that has been found to be advantageous is the one shown below, where the panning between the L-LS and R-Rs speakers pairs is a constant-power pan, and all other speaker pairing is panned with a constant-amplitude pan:

$$O = \begin{bmatrix} 0 & 0 & 0 & 0 & 0 & 0 & 0 & \frac{1}{3} & \frac{2}{3} & 1 & \sqrt{\frac{1}{2}} & 0 \\ 0 & 0 & 0 & 0 & \frac{1}{3} & \frac{2}{3} & 1 & \frac{2}{3} & \frac{1}{3} & 0 & 0 & 0 \\ 0 & 0 & \sqrt{\frac{1}{2}} & 1 & \frac{2}{3} & \frac{1}{3} & 0 & 0 & 0 & 0 & 0 & 0 \\ -\frac{1}{2} & 0 & 0 & 0 & 0 & 0 & 0 & 0 & 0 & 0 & \sqrt{\frac{1}{2}} & 1 \\ \frac{1}{2} & 1 & \sqrt{\frac{1}{2}} & 0 & 0 & 0 & 0 & 0 & 0 & 0 & 0 & 0 \end{bmatrix} \quad 1.5$$

Figure 5:
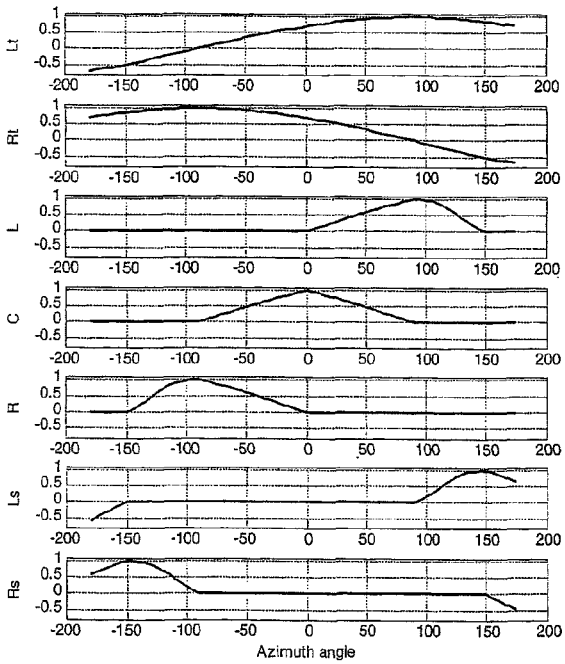
FIG. 5 is an example of the rows of I and O matrices, in which the I matrix has two outputs and the O matrix has five outputs, plotted against azimuth angle.

FIG. 5 shows the rows of the I and O matrices, plotted against the azimuth angle (the I matrix has 2 rows and the O matrix has 5 rows, so a total of seven curves are plotted). These plots actually show the panning curves with greater resolution than the matrices shown above (using angles quantized at 72 azimuth points around the listener, rather than 12 points). Note that the output panning curves shown here are based on a mixture of constant-power-panning between L-Ls and R-Rs, and constant-amplitude panning between other speaker pairs (as shown in Equation 1.5.).

In practice, a panning table for a matrix encoder (or, similarly for a decoder) contains a discontinuity at θ=180°, where the Lt and Rt gains "flip." It is possible to overcome this phase-flip by introducing a phase-shift in the surround channels, and this will then result in the gain values in the last two rows of Table 2 being complex rather than real.

As mentioned above, one may combine the Input and Output panning tables together in to a combined Input-Output Panning Table. Such a table, having paired entries and indexed by row numbers, is shown in Table 3.

TABLE 3

Combined Input-Output Panning Table

| Index (s) | Input Pan 1 | Input Pan 2 | . . . | Input Pan i | . . . | Input Pan NI | Output Pan 1 | Output Pan 2 | . . . | Output Pan o | . . . | Output Pan NO |
|---|---|---|---|---|---|---|---|---|---|---|---|---|
| 1 | $I_{1,1}$ | $I_{2,1}$ | . . . | $I_{i,1}$ | . . . | $I_{NI,1}$ | $O_{1,1}$ | $O_{2,1}$ | . . . | $O_{o,1}$ | . . . | $O_{NO,1}$ |
| 2 | $I_{1,2}$ | $I_{2,2}$ | . . . | $I_{i,2}$ | . . . | $I_{NI,2}$ | $O_{1,2}$ | $O_{2,2}$ | . . . | $O_{o,2}$ | . . . | $O_{NO,2}$ |
| . . . | . . . | . . . | . . . | . . . | . . . | . . . | . . . | . . . | . . . | . . . | . . . | . . . |

TABLE 3-continued

| Combined Input-Output Panning Table | | | | | | | | | | | |
|---|---|---|---|---|---|---|---|---|---|---|---|
| Index (s) | Input Pan 1 | Input Pan 2 | ... | Input Pan i | ... | Input Pan NI | Output Pan 1 | Output Pan 2 | ... | Output Pan o | ... | Output Pan NO |
| s | $I_{1,s}$ | $I_{2,s}$ | ... | $I_{i,s}$ | ... | $I_{NI,s}$ | $O_{1,s}$ | $O_{2,s}$ | ... | $O_{o,s}$ | ... | $O_{NO,s}$ |
| ... | ... | ... | ... | ... | ... | ... | ... | ... | ... | ... | ... | ... |
| NS | $I_{1,NS}$ | $I_{2,NS}$ | ... | $I_{i,NS}$ | ... | $I_{NI,NS}$ | $O_{1,NS}$ | $O_{2,NS}$ | ... | $O_{o,NS}$ | ... | $O_{NO,NS}$ |

One may assume that the input signals were created according to the mixing rules laid out in the Input Panning Table. One may also assume that the creator of the input signals produced these input signals by mixing a number of original source signals according to the scenarios in the Input Panning Table. For example, if two original source signals, $\text{Source}_3$ and $\text{Source}_8$, are mixed according to scenarios 3 and 8 in the Input Panning Table, then the input signals are:

$$\text{Input}_i = I_{i,3} \times \text{Source}_3 + I_{i,8} \times \text{Source}_8 \tag{1.6}$$

Hence, each input signal (i=1 . . . NI) is created by mixing together the original source signals, $\text{Source}_3$ and $\text{Source}_8$, according to the gain coefficients, $I_{i,3}$ and $I_{i,8}$, as defined in rows 3 and 8 of the Input Panning Table.

Ideally, the transformatter produces an output (NO channels) that matches as closely as possible to the ideal:

$$\text{IdealOutput}_o = O_{o,3} \times \text{Source}_3 + O_{o,8} \times \text{Source}_8 \tag{1.7}$$

Hence, each Ideal Output channel (o=1 . . . NO) is defined by mixing together the original source signals, $\text{Source}_3$ and $\text{Source}_8$, according to the gain coefficients, $O_{o,3}$ and $O_{o,8}$, as defined in rows 3 and 8 of the Output Panning Table.

Regardless of the actual number of original source signals used in the creation of the input signals (two signals in the example above), the mathematics are simplified if one assumes that there was one original source signal for each scenario in the panning tables (thus, the number of original source signals is equal to NS, although some of these source signals may be zero). In that case, equations 1.6 and 1.7 become:

$$Input_i = \sum_{s=1}^{NS} I_{i,s} \times Source_s \tag{1.8}$$

$$IdealOutput_o = \sum_{s=1}^{NS} O_{o,s} \times Source_s$$

Referring to FIG. 1, a goal of the M Transformatter is to minimize the magnitude-squared error between its output and the output of the O Ideal Decoder:

$$\begin{aligned} Error &= Output - IdealOut \\ &= M \times I \times S - O \times S \end{aligned} \tag{1.9}$$

$$\begin{aligned} \|Error\|^2 &= (Output_1 - IdealOut_1)^2 + \ldots + (Output_{NO} - IdealOut_{NO})^2 \\ &= trace((Output - IdealOut) \times (Output - IdealOut)^*) \end{aligned} \tag{1.10}$$

where the "*" operator indicates the conjugate-transpose of a matrix or vector.

Upon expansion of equation (1.10):

$$\begin{aligned} \|Error\|^2 &= trace((M \times I \times S - O \times S) \times (M \times I \times S - O \times S)^*) \\ &= trace((M \times I \times S - O \times S) \times (S^* \times I^* \times M^* - S^* \times O^*)) \\ &= trace\begin{pmatrix} M \times I \times S \times S^* \times I^* \times M^* - M \times I \times S \times S^* \times O^* - \\ O \times S \times S^* \times I^* \times M^* + O \times S \times S^* \times O^* \end{pmatrix} \end{aligned} \tag{1.11}$$

The goal is to minimize Eqn. 1.9 by equating the gradient of the above function to zero.

$$\text{Gradient} = \frac{\partial \|Error\|^2}{\partial M} = \begin{bmatrix} \frac{\partial \|Error\|^2}{\partial M_{1,1}} & \cdots & \frac{\partial \|Error\|^2}{\partial M_{NO,1}} \\ \vdots & \ddots & \vdots \\ \frac{\partial \|Error\|^2}{\partial M_{1,NI}} & \cdots & \frac{\partial \|Error\|^2}{\partial M_{NO,NI}} \end{bmatrix} \tag{1.12}$$

Using the commonly known matrix identity:

$$\frac{\partial trace(A \times X \times B)}{\partial X} = \frac{\partial trace(B^* \times X^* \times A^*)}{\partial X} = B \times A \tag{1.13}$$

$$\frac{\partial trace(A \times X \times B \times X^* \times C)}{\partial X} = B \times X^* \times C \times A + B^* \times X^* \times A^* \times C^* \tag{1.14}$$

one may simplify Eqn. 1.12:

$$\frac{\partial \|Error\|^2}{\partial M} = 2 \times I \times S \times S^* \times I^* \times M^* - 2 \times I \times S \times S^* \times O^* \tag{1.15}$$

Equating 1.15 to zero yields:

$$I \times S \times S^* \times I^* \times M^* = I \times S \times S^* \times O \tag{1.16}$$

Transposing both sides of Eqn. 1.16 yields:

$$M \times I \times S \times S^* \times I^* = O \times S \times S^* \times I^* \tag{1.17}$$

As indicated by Eqn. (1.17), the optimum value for the matrix, M, is dependent on the two matrices I and O as well as S×S*. As mentioned above, I and O are known, thus optimizing the M Transformatter may be achieved by estimating S×S*, the covariance of the source signals. The Source Covariance matrix may be expressed as:

$$\mathrm{cov}(S) = S \times S^* \tag{1.18}$$

$$= \begin{bmatrix} Source_1(t) \times \overline{Source_1(t)} & \dots & Source_1(t) \times \overline{Source_{NS}(t)} \\ \vdots & \ddots & \vdots \\ Source_{NS}(t) \times \overline{Source_1(t)} & \dots & Source_{NS}(t) \times \overline{Source_{NS}(t)} \end{bmatrix}$$

In principle, the Transformatter may generate a new estimate of the covariance S×S* every sample period so that a new matrix, M, may be computed every sample period. Although this may produce minimal error, it may also result in undesirable distortion in the audio produced by a system employing the M Transformatter. To reduce or eliminate such distortion, smoothing may be applied to the time-update of M. Thus, a slowly varying and less frequently updated determination of S×S* may be employed.

In practice, the Source Covariance matrix may be constructed by time averaging over a time window :

$$\mathrm{cov}(S) = S \times S^* = \dots \frac{1}{2\Delta t} \tag{1.19}$$

$$\int_{\tau=t-\Delta t}^{\tau+\Delta t} \begin{bmatrix} Source_1(\tau) \times \overline{Source_1(\tau)} & \dots & Source_1(\tau) \times \overline{Source_{NS}(\tau)} \\ \vdots & \ddots & \vdots \\ Source_{NS}(\tau) \times \overline{Source_1(\tau)} & \dots & Source_{NS}(\tau) \times \overline{Source_{NS}(\tau)} \end{bmatrix} d\tau$$

One may use the shorthand notation:

$$\mathrm{cov}(S) = S \times S^* = \dots \underset{\tau \text{ near } t}{avg} \begin{bmatrix} Source_1(\tau) \times \overline{Source_1(\tau)} & \dots & Source_1(\tau) \times \overline{Source_{NS}(\tau)} \\ \vdots & \ddots & \vdots \\ Source_{NS}(\tau) \times \overline{Source_1(\tau)} & \dots & Source_{NS}(\tau) \times \overline{Source_{NS}(\tau)} \end{bmatrix} \tag{1.20}$$

Ideally, the time-averaging process should look forward and backward in time (as per Equation (1.19), but a practical system may not have access to future samples of the input signals. Therefore, a practical system may be limited to using past input samples for statistical analysis. Delays may be added elsewhere in the system, however, to provide the effect of a "look-ahead.". (See the "Delay" block in FIG. 6).

The ISSI and OSSI Matrices

Equation 1.19 includes the terms I×S×S*×I and O×S×S*×I. As a faun of simplified nomenclature, ISSI and OSSI are used in reference to these matrices. For a 2-channel input to 5-channel output Transformatter, ISSI is a 2×2 matrix, and OSSI is a 5×2 matrix. Consequently, regardless of the size of the S vector (which may be quite large), the ISSI and OSSI matrices are relatively small. An aspect of the present invention is that not only is the size of the ISSI and OSSI matrices independent of the size of S, but it is unnecessary to have direct knowledge of S.

There a several ways one may interpret the meaning of the ISSI and OSSI matrices. If one has formed an estimate of the Source Covariance (S×S*), then one may think of ISSI and OSSI as:

$$ISSI = I \times (S \times S^*) \times I^* = I \times \mathrm{cov}(S) \times I^*$$

$$OSSI = O \times (S \times S^*) \times I^* = O \times \mathrm{cov}(S) \times I^* \tag{1.21}$$

The equations above reveal that one may make use of the Source Covariance, S×S*, to compute ISSI and OSSI. It is an aspect of the present invention that in order to compute the optimal value of M, one need not know the actual source signals 5, but only the Source Covariance S×S*.

Alternatively, ISSI and OSSI may be interpreted as follows:

$$ISSI = (I \times S) \times (I \times S)^* = \mathrm{Input} \times Input^* = \mathrm{cov}(\mathrm{Input}) = \underset{\tau \text{ near } t}{avg} \begin{bmatrix} Input_1(\tau) \times \overline{Input_1(\tau)} & \dots & Input_1(\tau) \times \overline{Input_{NI}(\tau)} \\ \vdots & \ddots & \vdots \\ Input_{NI}(\tau) \times \overline{Input_1(\tau)} & \dots & Input_{NI}(\tau) \times \overline{Input_{NI}(\tau)} \end{bmatrix} \tag{1.22}$$

$$OSSI = (O \times S) \times (I \times S)^* = \mathrm{cov}(IdealOut, \mathrm{Input}) = \underset{\tau \text{ near } t}{avg} \begin{bmatrix} IdealOut_1(\tau) \times \overline{Input_1(\tau)} & \dots & IdealOut_1(\tau) \times \overline{Input_{NI}(\tau)} \\ \vdots & \ddots & \vdots \\ IdealOut_{NO}(\tau) \times \overline{Input_1(\tau)} & \dots & IdealOut_{NO}(\tau) \times \overline{Input_{NI}(\tau)} \end{bmatrix} \tag{1.23}$$

Thus, according to further aspects of the present invention:

The ISSI Matrix is the Covariance of the Transformatter's Input signals, and may be determined without any knowledge of the Source Signals S.

The OSSI Matrix is the Cross-Covariance between the IdealOut signals and the Transformatter Input signals. Unlike the ISSI matrix, it is necessary to know either (a) the Covariance of the source signals S×S* in order to compute the value of the OSSI matrix or (b) an estimate of the IdealOut signals (the Input signals being known).

According to aspects of the present invention, an approximation (such as a least-mean-square approximation) to controlling the M Transformatter so as to minimize the difference between the Output signals and the IdealOutput signals may be accomplished in the following manner, for example:

Take the Input signals ($\mathrm{Input}_1$, $\mathrm{Input}_2$, . . . $\mathrm{Input}_{NI}$) to the M Transformatter and compute their covariance (the ISSI matrix). By examination of the covariance data, make an estimate of which rows of an Input Panning Table were used to create the input data (a power estimate of the original source signals). Then, use the Input and Output panning tables to estimate the Input to IdealOutput cross-covariance. Then, use the Input Covariance, and the Input-IdealOutput Cross Covariance, to compute the mix matrix M, and then apply this matrix to the input signals to produce the Output signals. As discussed further below, if the original source signals are assumed to be mutually uncorrelated with one another, an estimate of the Input-IdealOutput Cross-covariance may be obtained without reference to panning tables.

One may replace the Input and Output panning tables with new ISSI and OSSI tables. For example, if an original Input/Output panning table is shown in Table 3, then an ISSI/OSSI lookup table will look like Table 4.

TABLE 4

The ISSI/OSSI lookup table

| s | ISSI Lookup | OSSI Lookup |
|---|---|---|
| 1 | $\text{Lookup}_{ISSI}(1) = \begin{bmatrix} I_{1.1}\overline{I_{1.1}} & \cdots & I_{1.1}\overline{I_{NI.1}} \\ \vdots & \ddots & \vdots \\ I_{NI.1}\overline{I_{1.1}} & \cdots & I_{NI.1}\overline{I_{NI.1}} \end{bmatrix}$ | $\text{Lookup}_{OSSI}(1) = \begin{bmatrix} O_{1.1}\overline{I_{1.1}} & \cdots & O_{1.1}\overline{I_{NI.1}} \\ \vdots & \ddots & \vdots \\ O_{NO.1}\overline{I_{1.1}} & \cdots & O_{NO.1}\overline{I_{NI.1}} \end{bmatrix}$ |
| 2 | $\text{Lookup}_{ISSI}(2) = \begin{bmatrix} I_{1.2}\overline{I_{1.2}} & \cdots & I_{1.2}\overline{I_{NI.2}} \\ \vdots & \ddots & \vdots \\ I_{NI.2}\overline{I_{1.2}} & \cdots & I_{NI.2}\overline{I_{NI.2}} \end{bmatrix}$ | $\text{Lookup}_{OSSI}(2) = \begin{bmatrix} O_{1.2}\overline{I_{1.2}} & \cdots & O_{1.2}\overline{I_{NI.2}} \\ \vdots & \ddots & \vdots \\ O_{NO.2}\overline{I_{1.2}} & \cdots & O_{NO.2}\overline{I_{NI.2}} \end{bmatrix}$ |
| ... | ... | ... |
| s | $\text{Lookup}_{ISSI}(s) = \begin{bmatrix} I_{1.s}\overline{I_{1.s}} & \cdots & I_{1.s}\overline{I_{NI.s}} \\ \vdots & \ddots & \vdots \\ I_{NI.s}\overline{I_{1.s}} & \cdots & I_{NI.s}\overline{I_{NI.s}} \end{bmatrix}$ | $\text{Lookup}_{OSSI}(s) = \begin{bmatrix} O_{1.s}\overline{I_{1.s}} & \cdots & O_{1.s}\overline{I_{NI.s}} \\ \vdots & \ddots & \vdots \\ O_{NO.s}\overline{I_{1.s}} & \cdots & O_{NO.s}\overline{I_{NI.s}} \end{bmatrix}$ |
| ... | ... | ... |
| NS | $\text{Lookup}_{ISSI}(NS) = \begin{bmatrix} I_{1.NS}\overline{I_{1.NS}} & \cdots & I_{1.NS}\overline{I_{NI.NS}} \\ \vdots & \ddots & \vdots \\ I_{NI.NS}\overline{I_{1.NS}} & \cdots & I_{NI.NS}\overline{I_{NI.NS}} \end{bmatrix}$ | $\text{Lookup}_{OSSI}(NS) = \begin{bmatrix} O_{1.NS}\overline{I_{1.NS}} & \cdots & O_{1.NS}\overline{I_{NI.NS}} \\ \vdots & \ddots & \vdots \\ O_{NO.NS}\overline{I_{1.NS}} & \cdots & O_{NO.NS}\overline{I_{NI.NS}} \end{bmatrix}$ |

By using the ISSI/OSSI lookup table, according to aspects of the present invention, an approximation (such as a least-mean-square approximation) to controlling the M Transformatter so as to minimize the difference between the Output signals and the IdealOutput signals may be accomplished in the following manner, for example:

Take input signals ($\text{Input}_1$, $\text{Input}_2$, $\text{Input}_{NI}$) and compute their covariance (the ISSI matrix). Make an estimate of which rows of the ISSI/OSSI Lookup Table were used to create the input covariance data (a power estimate of the original source signals), by matching the calculated Input covariance with the $\text{Lookup}_{ISSI}$ values in the ISSI/OSSI lookup table. Then, use the $\text{Lookup}_{OSSI}$ values to compute the corresponding Input to IdealOutput cross-covariance. Then, use the Input Covariance, and the Input-Output Cross Covariance, to compute the mix matrix M, and then apply this matrix to the input signals to produce the output signals.

Figure 6:
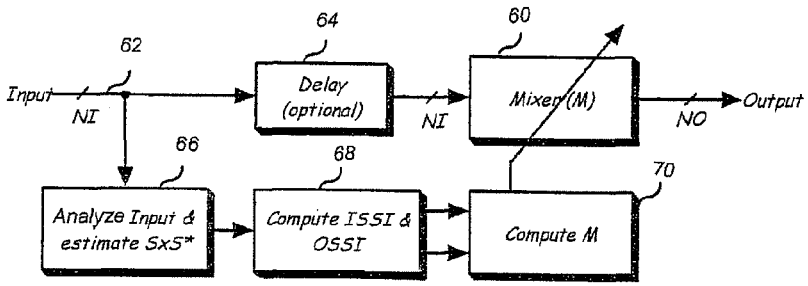
FIG. 6 is a functional diagram that illustrates an example of an M Transformatter in accordance with aspects of the present invention.

The functional diagram of FIG. 6 illustrates an example of an M Transformatter in accordance with aspects of the present invention. The core operator of the M Transformatter, mixer or mixing function ("Mixer (M)") 60 in a first path 62, a signal path, receives the NI Input signals via an optional Delay 64 and puts out the NO Output signals. The M Mixer 60 comprises a NO×NI matrix M to map the NI input signals to the NO output signals in accordance with Equation 1.3 The coefficients of M Mixer 60 may be time-varied by the processing of a second path or "side-chain," a control path, having three devices or functions:

The Input signals are analyzed by a device or function 66 ("Analyze Input & estimate S×S*), to build an estimate of the Covariance of the Source signals S.

The Source Covariance estimate is used to compute the ISSI and OSSI matrices in a device or function 68 ("Compute ISSI & OSSI").

The ISSI and OSSI matrices are used by a device or function 70 ("Compute M") to compute the mixer coefficients M.

The side-chain attempts to make inferences about the source signals by trying to find a likely estimate of S×S*. This process may be assisted by taking windowed blocks of input audio so that a statistical analysis may be made over a reasonable-sized set of data.

In addition, some time smoothing may be applied in the computation of S×S*, ISSI, OSSI and/or M. As a result of the block-processing and smoothing operations, it is possible that the computation of the coefficients of the mixer M may lag behind the audio data, and it may therefore be advantageous to delay the inputs to the mixer as indicated by the optional Delay 64 in FIG. 6. The matrix, M, has NO rows and NI columns, and defines a linear mapping between the NI input signals and the NO output signals. It may also be referred to as an "Active Matrix Decoder" because it is continuously updated over time to provide an appropriate mapping function based on the current observed properties of the input signals.

A Closer Look at the Source Covariance S×S*

If a number (NS) of pre-defined source locations are used to represent the listening experience, it may be theoretically possible to present the listener with the impression of a sound arrival from any arbitrary direction by creating phantom (panned) images between the source locations. However, if the number of source locations (NS) is sufficiently large, the need for phantom image panning may be avoided and one may assume that the Source signals $\text{Source}_1, \ldots \text{Source}_{NS}$, are mutually uncorrelated. Although untrue in the general case, experience has shown that the algorithm performs well regardless of this simplification. A Transformatter according to aspects of the present invention is calculated in a manner that assumes that the Source signals are mutually uncorrelated.

The most significant side effect of this assumption is that the Source Covariance matrix becomes diagonal:

$$cov(S) = S \times S^* = \underset{\tau\ near\ t}{avg} \begin{bmatrix} |Source_1(\tau)|^2 & 0 & \dots & 0 \\ 0 & |Source_2(\tau)|^2 & \dots & 0 \\ \vdots & \vdots & \ddots & \vdots \\ 0 & 0 & \dots & |Source_{NS}(\tau)|^2 \end{bmatrix} \quad (1.24)$$

Figure 7:
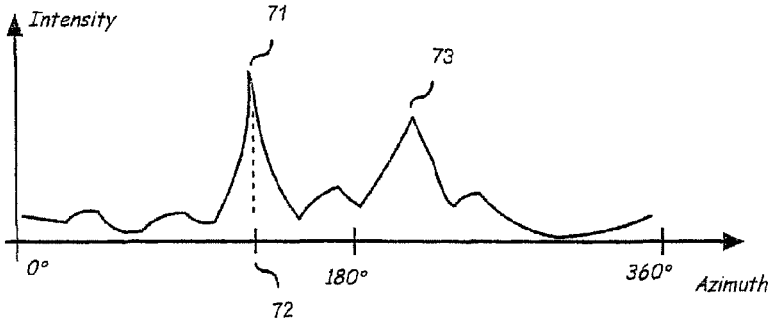
FIG. 7 is a notional illustration of source power as a function of azimuthal location useful in understanding aspects of the present invention.

Consequently, estimation of the ISSI and OSSI matrices is reduced to a simpler task, estimating the relative power of the source signals: $Source_1$, $Source_2$, . . . $Source_{NS}$ at varied azimuthal locations surrounding a listener as shown in the example of FIG. 2. The Source Covariance matrix (NS×NS) may therefore be thought of in terms of a source power column vector (NS×1) as in Equation 1.24, wherein a notional illustration of the source power as a function of azimuthal location may be, for example, as shown in FIG. 7. A peak in the intensity distribution, such as at 301, indicates elevated source power at the angle indicated by 302 (FIG. 7)

Direction-of-Arrival Estimation

Figure 8:
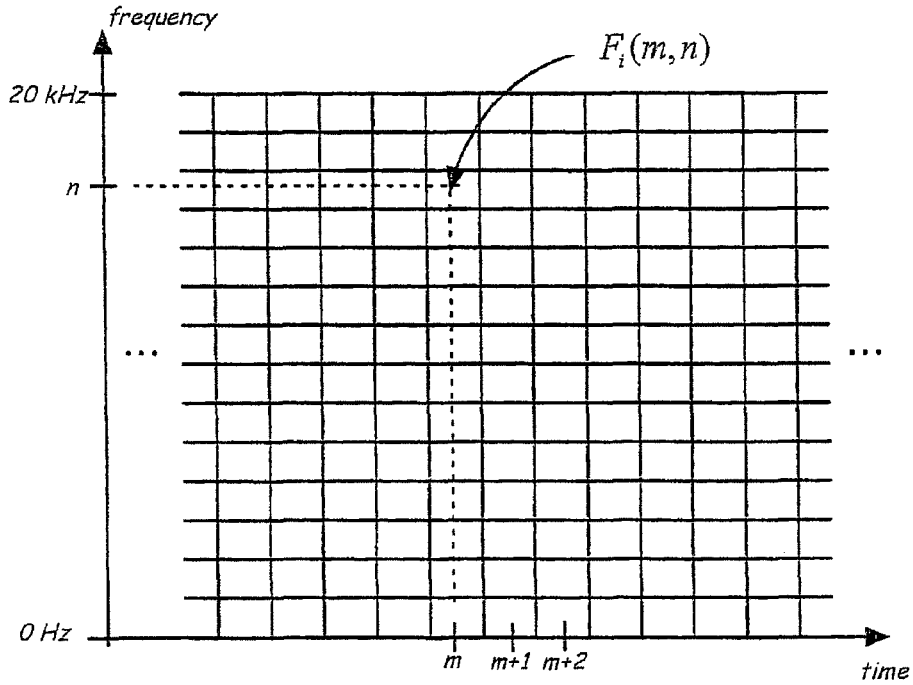
FIG. 8 is a conception of Short-Term Fourier Transform (STFT) space that is useful in understanding aspects of the present invention.

As shown in the block diagram of FIG. 6, analysis of the Input signals includes the estimation of the Source Covariance (S×S*). As mentioned above, the estimation of S×S* may be obtained from determining the power versus azimuth distribution by utilizing the covariance of the input signals. This may be done by making use of the so-called Short-Term Fourier Transform, or STFT. A conception of STFT space is shown in FIG. 8 in which the the vertical axis is frequency, being divided into n frequency bands or bins (up to about 20 kHz) and the horizontal axis is time, being divided into time intervals m. An arbitrary frequency-time segment $F_1(m,n)$ is shown. Time slots following slot m are shown as slots m+1 and m+2.

Time-dependent Fourier Transform data may be segregated into contiguous frequency bands Δf and integrated over varying time intervals Δt, such that the product Δf×Δt is held at a predetermined (but not necessarily fixed) value, the simplest case being that it is held constant. By extracting information from the data associated with each frequency band, a power level and estimated azimuthal source angle may be inferred. The ensemble of such information over all frequency bands may provide one with a relatively complete estimate of the source power versus azimuthal angle distribution such as in the example of FIG. 7.

Figure 9:
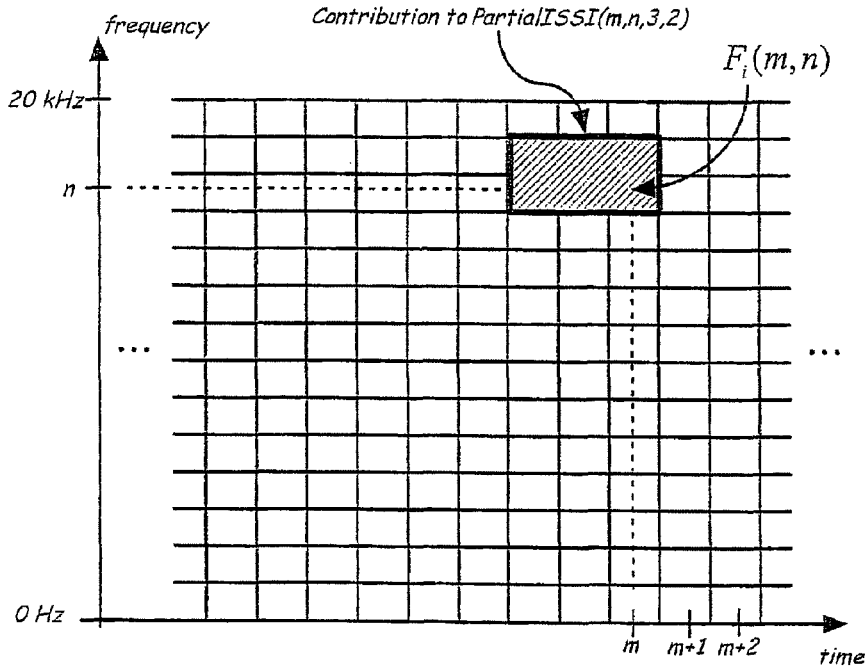
FIG. 9 shows an example in STFT space of a frequency and time segment having a time length of three time slots and a frequency height of two bins.
Figure 10:
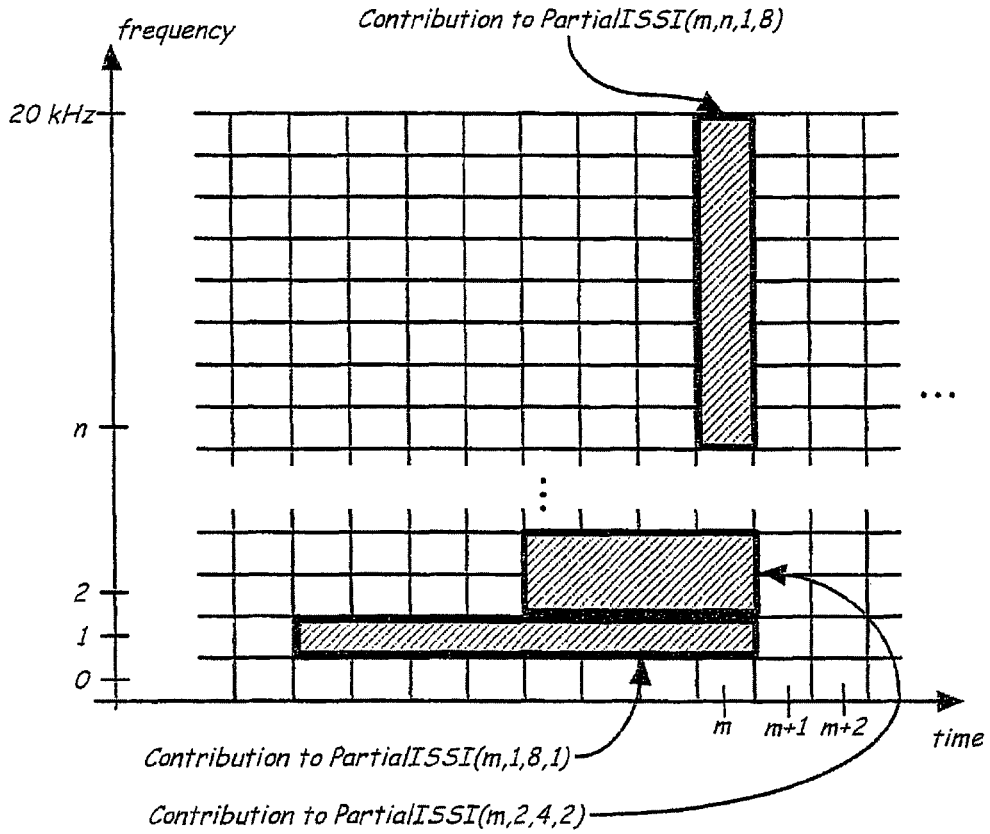
FIG. 10 shows examples of multiple frequency and time segments in which the time/frequency resolution varies between low and high frequencies, in a manner that is similar to human perceptual bands.

FIGS. 8, 9 and 10 illustrate an STFT method. Various frequency bands, Δf, are integrated over varying time intervals, Δt. Generally speaking, lower frequencies may be integrated over a longer time than higher frequencies. An STFT provides a set of Complex Fourier coefficients at each time interval and at each frequency bin.

The STFT transforms the original vector of time-sampled Input signals into a set of sampled Fourier coefficients:

$$STFT_{Input}(m, n) = \begin{bmatrix} F_1(m, n) \\ \vdots \\ F_{NI}(m, n) \end{bmatrix} \quad (1.25)$$

The covariance of the input signal over such time/frequency intervals is then determined. These are referred to as PartialISSI(m,n,Δm,Δn) because they are determined from only part of the input signal.

$$PartialISSI(m, n, \Delta m, \Delta n) = \sum_{m'=0}^{\Delta m-1} \sum_{n'=0}^{\Delta n-1} (STFT_{Input}(m-m', n+n') \times STFT_{Input}(m-m', n+n')^*) \quad (1.26)$$

where m refers to the beginning time index and Δm, its duration. Similarly, n refers to the initial frequency bin and Δn, to its extent. FIG. 9 illustrates the case for which Δm=3 and Δn=2.

The grouping of time/frequency blocks may be done in a number of ways. Although not critical to the invention, the following examples have been found useful:

- The number of Fourier coefficients that are combined in the calculation of PartialISSI(m,n,Δm,Δn), is equal to Δm×Δn. In order to compute a reasonable unbiased estimate of the covariance, Δm×Δn should be at least 10. In practice, it has been found useful to use a larger block, such that Δm×Δn=32.
- In the lower frequency range, it is often advantageous to set Δn=1 and Δm=32, effectively providing higher frequency selectivity at lower frequency, at the cost of increased time smearing.
- In the higher frequency range, it is often advantageous to set Δn=32 and Δm=1, effectively providing lower frequency selectivity at higher frequencies, but with the advantage of improved time-resolution. This concept is illustrated in FIG. 10 wherein a time/frequency resolution that varies between low and high frequencies, in a manner that is similar to human perceptual bands.

The PartialISSI covariance calculations may be done using the time-sampled $Input_i(t)$ signals. However, the use of the STFT coefficients allows PartialISSI to be more easily computed on different frequency bands, as well as providing the added capability for extracting phase information from the PartialISSI calculations.

Direction of Arrival Distribution for the Matrix Decoder

Extraction of the source azimuthal angle from each PartialISSI matrix is exemplified below for the case of two (NI=2) input channels. The input signal is presumed to be composed of two signal components:

$$\text{Input} = SteeredSignal + DiffuseSignal \quad (1.27)$$

$$SteeredSignal = \begin{bmatrix} \cos\left(\frac{\theta - 90°}{2}\right) \\ \cos\left(\frac{\theta + 90°}{2}\right) \end{bmatrix} \times Sig(t) \quad (1.28)$$

$$DiffuseSignal = \begin{bmatrix} Noise_L(t) \\ Noise_R(t) \end{bmatrix} \quad (1.29)$$

where the RMS power of the component signals is given by:

$$\text{rms}(Noise_L(t)) = \text{rms}(Noise_L(t)) = \frac{\sigma_{noise}}{\sqrt{2}} \quad (1.30)$$

$$\text{rms}(Sig(t)) = \sigma_{sig}$$

In other words, the directional or "steered" signal is composed of a Source signal (Sig(t)) that has been panned to the input channels, based on Source direction θ, whereas the diffuse signal is composed of uncorrelated noise equally spread in both input channels.

The covariance matrix is:

$$\mathrm{cov}(\mathrm{Input}) = \underset{\tau heart}{mean}(\mathrm{Input} \times Input^*) \tag{1.31}$$

$$= \begin{bmatrix} \frac{\sigma_{noise}^2}{2} + \sigma_{sig}^2 \cos^2\left(\frac{\theta - 90^\circ}{2}\right) & \sigma_{sig}^2 \cos\left(\frac{\theta - 90^\circ}{2}\right)\cos\left(\frac{\theta + 90^\circ}{2}\right) \\ \sigma_{sig}^2 \cos\left(\frac{\theta - 90^\circ}{2}\right)\cos\left(\frac{\theta + 90^\circ}{2}\right) & \frac{\sigma_{noise}^2}{2} + \sigma_{sig}^2 \cos^2\left(\frac{\theta + 90^\circ}{2}\right) \end{bmatrix} \tag{1.32}$$

$$= \begin{bmatrix} \frac{\sigma_{noise}^2}{2} + \sigma_{sig}^2\left(\frac{1}{2} + \frac{1}{2}\sin(\theta)\right) & \sigma_{sig}^2 \frac{1}{2}\cos(\theta) \\ \sigma_{sig}^2 \frac{1}{2}\cos(\theta) & \frac{\sigma_{noise}^2}{2} + \sigma_{sig}^2\left(\frac{1}{2} - \frac{1}{2}\sin(\theta)\right) \end{bmatrix} \tag{1.33}$$

This covariance matrix has two eigenvalues:

$$\lambda_1 = \frac{\sigma_{noise}^2}{2} \tag{1.34}$$

$$\lambda_2 = \frac{\sigma_{noise}^2}{2} + \sigma_{sig}^2$$

Examination of the eigenvalues of the covariance matrix reveals the amplitudes of $\sigma_{noise}$, the diffuse signal component and $\sigma_{sig}$, the steered signal component. Furthermore, the appropriate trigonometric manipulation may be used to extract the angle, θ, as follows:

$$Cov_{1,1} = \frac{\sigma_{noise}^2}{2} + \sigma_{sig}^2\left(\frac{1}{2} + \frac{1}{2}\sin(\theta)\right) \tag{1.35}$$

$$Cov_{2,2} = \frac{\sigma_{noise}^2}{2} + \sigma_{sig}^2\left(\frac{1}{2} - \frac{1}{2}\sin(\theta)\right)$$

$$Cov_{1,2} = Cov_{2,1} = \sigma_{sig}^2 \frac{1}{2}\cos(\theta)$$

$$\therefore \cos(\theta) = \frac{Cov_{1,2} + Cov_{2,1}}{\sigma_{sig}^2},\ \sin(\theta) = \frac{Cov_{1,1} - Cov_{2,2}}{\sigma_{sig}^2}$$

$$\therefore \theta = \tan^{-1}(Cov_{1,1} - Cov_{2,2},\ Cov_{1,2} + Cov_{2,1})$$

Figure 11:
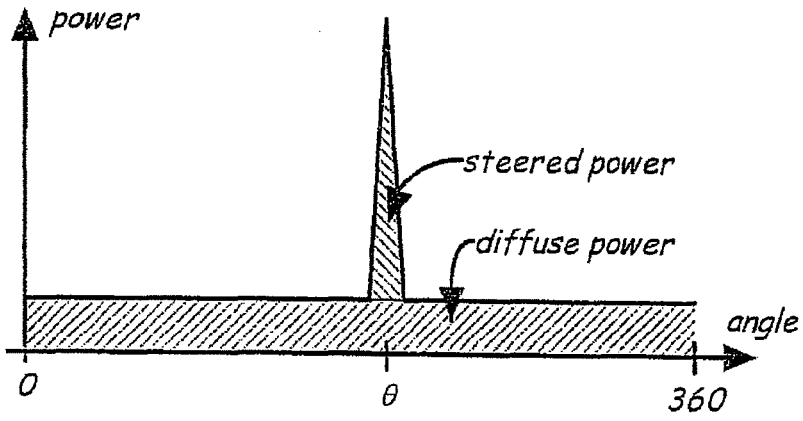
FIG. 11 shows conceptually the extraction, from a frequency and time segment, estimates of a steered signal component, a diffuse signal component, and a source azimuthal direction.
Figure 12:
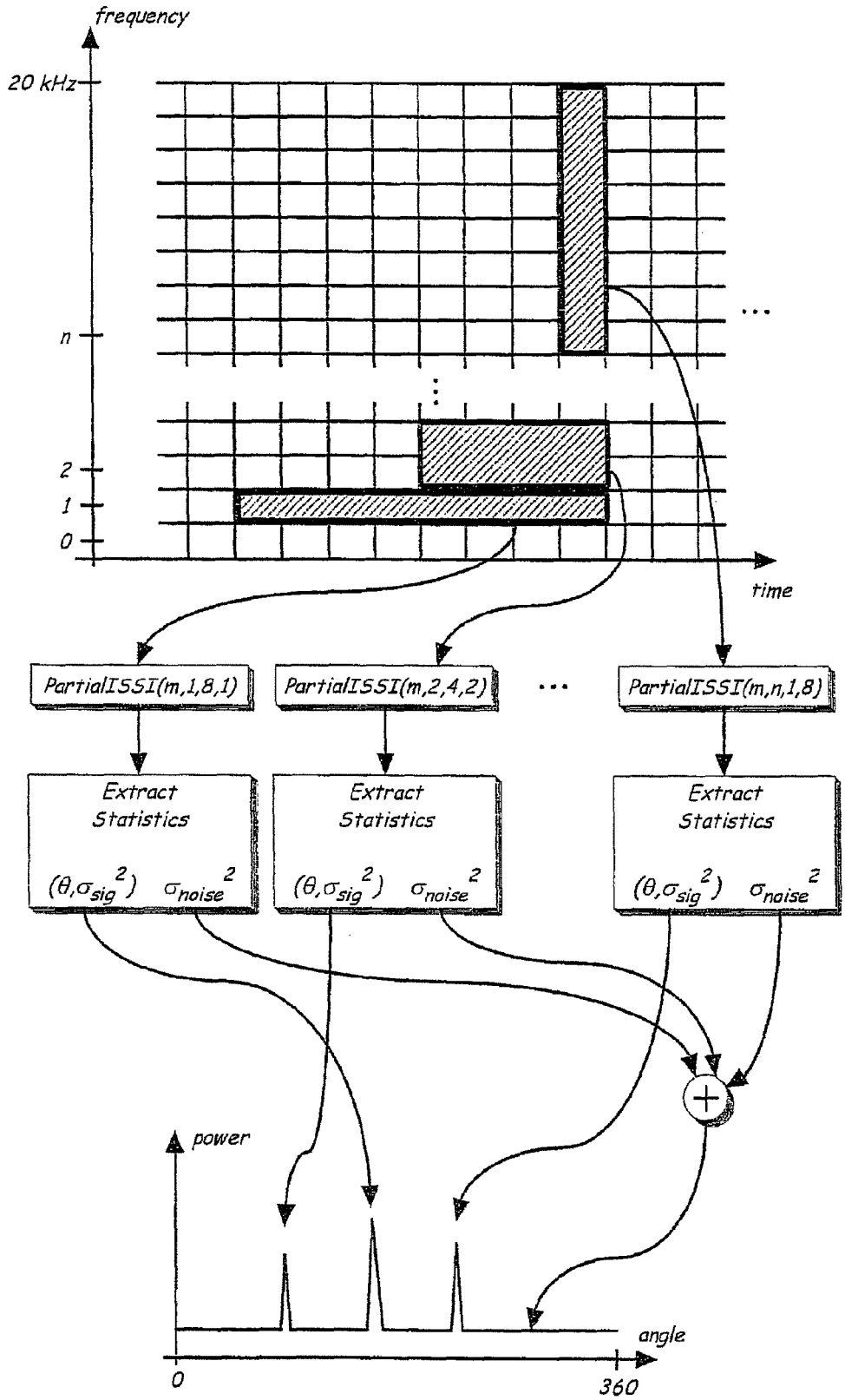
FIG. 12 shows conceptually the combining, from a plurality of frequency and time segments, estimates of steered signal component, a diffuse signal component, and a source azimuthal direction.
Figure 13:
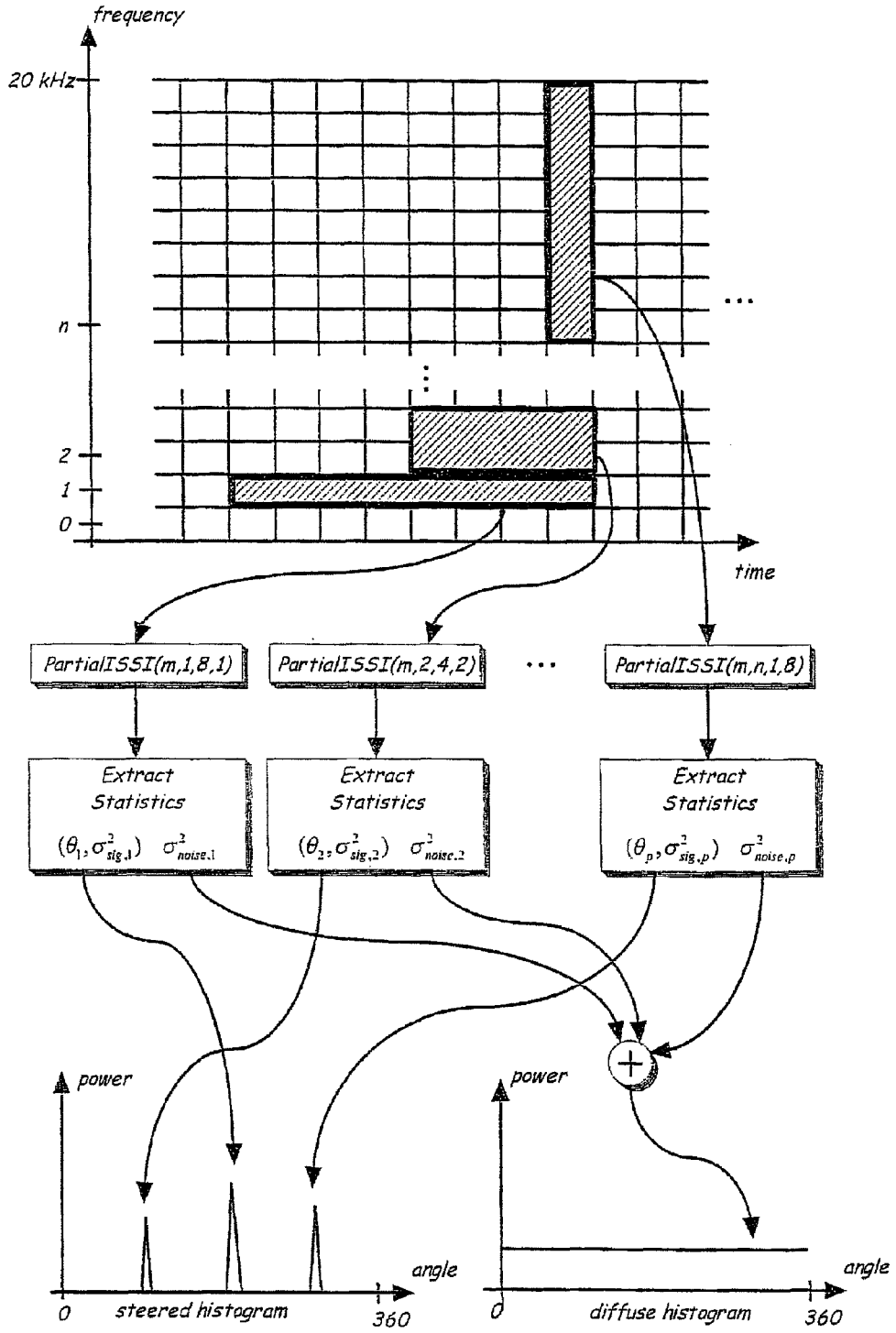
FIG. 13 show a variation of FIG. 12 in which the diffuse signal component estimates are combined separately from the steered signal component and source azimuthal direction estimates.
Figure 14:
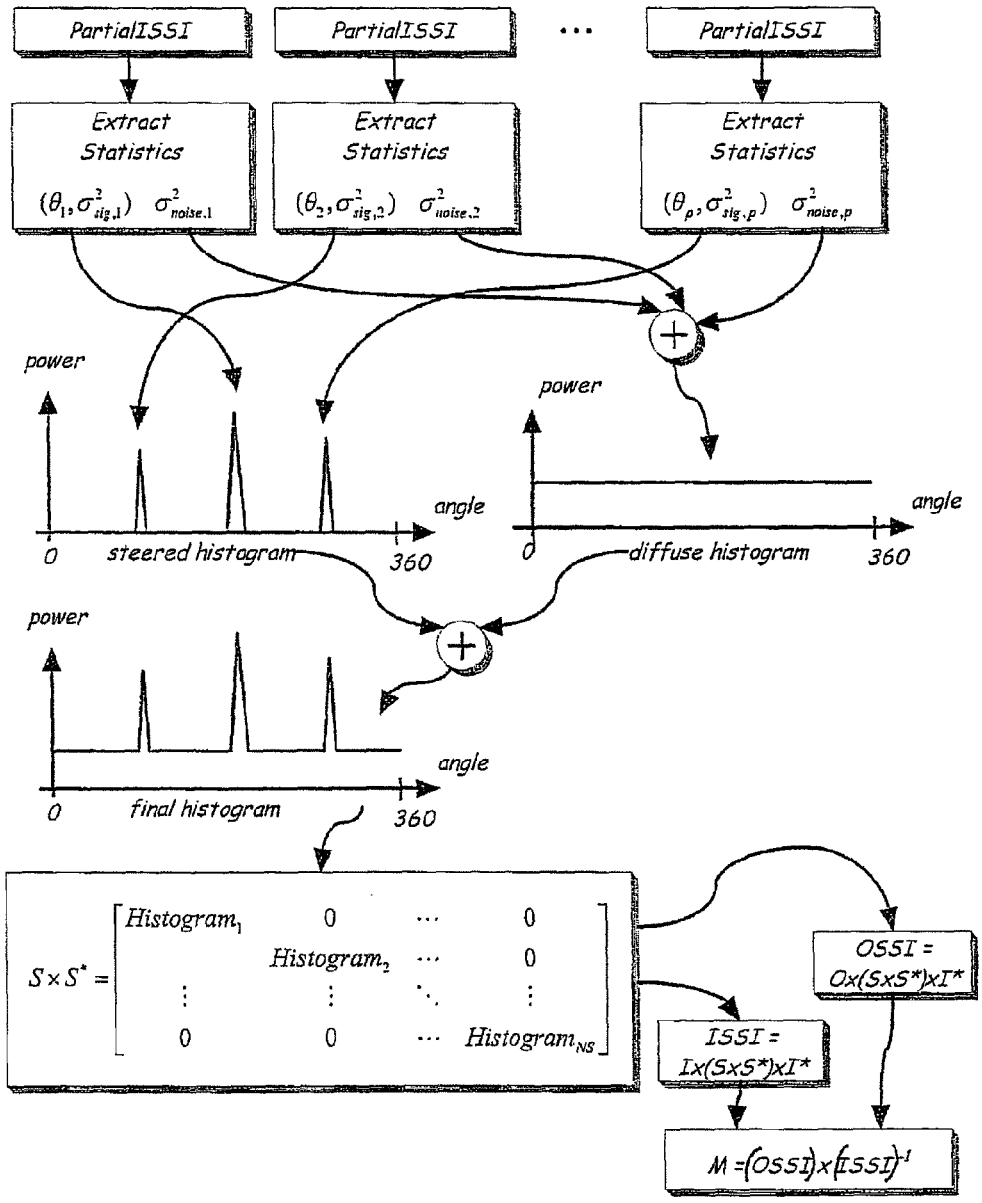
FIG. 14 shows a variation of FIG. 13 in which the M matrix is calculated by steps that include estimating a covariance matrix of notional source signals, the estimating including the simplification of the estimation by diagonalizing the covariance matrix.
Figure 15:
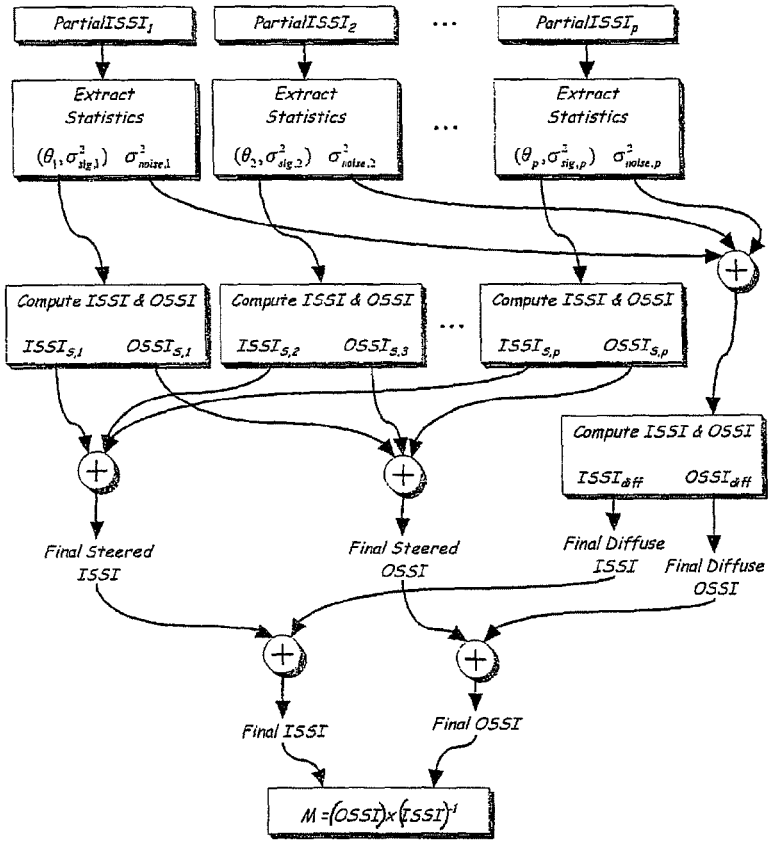
FIG. 15 shows a variation of FIG. 14 in which the steps of the FIG. 14 example are re-arranged.

In this manner, each PartialISSI matrix may be analyzed to extract estimates of the steered signal component, the diffuse signal component, and the source azimuthal direction as shown in FIG. 11. An ensemble of data from a complete set of PartialISSI may then be combined together to form a single composite distribution, as shown in FIG. 12. In practice, it is preferred to keep the steered distribution data separate from the diffuse distribution data, as shown in FIG. 13. In the signal flow of FIG. 14, the formation of the distribution from the extracted signal statistics is a linear operation since each PartialISSI calculation yields its own steered and diffuse distribution data, and these are linearly summed together to form the final distribution. Furthermore, the final distribution is used to create ISSI and OSSI via a process that is also linear. Since these steps are linear, one may re-arrange them, in order to simplify the calculations, as shown in FIG. 15.

Computing the Steered and Diffuse ISSI and OSSI Matrixes

The FinalISSI and FinalOSSI are computed as follows:

$$\mathrm{FinalISSI} = \mathrm{ISSI}_{diff} + \mathrm{ISSI}_{steered}$$

$$\mathrm{FinalOSSI} = \mathrm{OSSI}_{diff} + \mathrm{OSSI}_{steered} \tag{1.36}$$

where analysis of the PartialISSI matrices is used to compute parameters for each component. The total steered component for the ISSI and OSSI matrices are:

$$ISSI_{steered} = \sum_p ISSI_{steered,p} \tag{1.37}$$

$$OSSI_{steered} = \sum_p OSSI_{steered,p}$$

where the summation over p indicates summation over all respective PartialISSI and PartialOSSI contributions.

From the analysis of each PartialISSI matrix, one obtains the signal power amplitude $\sigma_{sig}$, diffuse power amplitude $\sigma_{noise}$, and the associated source azimuthal angle θ. Each PartialISSI matrix may be rewritten as follows:

$$ISSI_p = \underbrace{\frac{\sigma_{noise}^2}{2}\begin{bmatrix} 1 & 0 \\ 0 & 1 \end{bmatrix}}_{ISSI_{diff,p}} + \underbrace{\sigma_{sig}^2 \begin{bmatrix} \left(\frac{1}{2} + \frac{1}{2}\sin(\theta)\right) & \frac{1}{2}\cos(\theta) \\ \frac{1}{2}\cos(\theta) & \left(\frac{1}{2} - \frac{1}{2}\sin(\theta)\right) \end{bmatrix}}_{ISSI_{steered,p}} \tag{1.38}$$

Where the first term in the above equation is the diffuse component and the second is the steered component. It is important to note the following:

- The diffuse component, $\mathrm{ISSI}_{diff,p}$, is the product of a scalar and the identity matrix. It is independent of the azimuthal angle θ.
- The steered component, $\mathrm{ISSI}_{steered,p}$, is the product of a scalar and a matrix having elements depending only on the azimuthal angle θ. The latter is conveniently stored in a precalculated lookup table, indexed by the nearest neighbor azimuthal angle.

The $\mathrm{OSSI}_{diff,p}$ and $\mathrm{OSSI}_{steered,p}$ matrices may be similarly defined.

The Steered ("Directional") Component

The steered terms may be written as follows:

$$\mathrm{ISSI}_{steered,p} = \sigma_{sig,p}^2 \times \mathrm{Lookup}_{ISSI}(\theta)$$

$$\mathrm{OSSI}_{steered,p} = \sigma_{sig,p}^2 \times \mathrm{Lookup}_{OSSI}(\theta) \tag{1.39}$$

where, for the present example:

$$Lookup_{ISSI}(\theta) = \begin{bmatrix} I_{1,\theta} \times I_{1,\theta}^* & I_{1,\theta} \times I_{2,\theta}^* \\ I_{2,\theta} \times I_{1,\theta}^* & I_{2,\theta} \times I_{2,\theta}^* \end{bmatrix} \tag{1.40}$$

and

-continued $$Lookup_{OSI}(\theta) = \begin{bmatrix} O_{1,\theta} \times I^*_{1,\theta} & O_{1,\theta} \times I^*_{2,\theta} \\ O_{2,\theta} \times I^*_{1,\theta} & O_{2,\theta} \times I^*_{2,\theta} \\ O_{3,\theta} \times I^*_{1,\theta} & O_{3,\theta} \times I^*_{2,\theta} \\ O_{4,\theta} \times I^*_{1,\theta} & O_{4,\theta} \times I^*_{2,\theta} \\ O_{5,\theta} \times I^*_{1,\theta} & O_{5,\theta} \times I^*_{2,\theta} \end{bmatrix} \tag{1.41}$$

An example of the $I_{k,\theta}$is:

$$I_{1,\theta} = \cos\left(\frac{\theta - 90°}{2}\right) \tag{1.42}$$

$$I_{2,\theta} = \cos\left(\frac{\theta + 90°}{2}\right)$$

And similarly for the $O_{k,\theta}$:

$$O_{1,\theta} = \cos\left(\frac{\theta - 150°}{2}\right) \tag{1.43}$$

$$O_{2,\theta} = \cos\left(\frac{\theta - 90°}{2}\right)$$

$$O_{3,\theta} = \cos\left(\frac{\theta}{2}\right)$$

$$O_{4,\theta} = \cos\left(\frac{\theta + 90°}{2}\right)$$

$$O_{5,\theta} = \cos\left(\frac{\theta + 150°}{2}\right)$$

The Diffuse Component

The total DiffuseISSI and total DiffuseOSSI matrices may be written as:

$$ISSI_{diff} = \left(\sum_p \sigma^2_{noise,p}\right) \times DesiredDiffuseISSI \tag{1.44}$$

$$OSSI_{diff} = \left(\sum_p \sigma^2_{noise,p}\right) \times DesiredDiffuseOSSI$$

where DesiredDiffuseISSI and DesiredDiffuseOSSI are pre-computed matrices designed to decode a diffuse input signal in the same manner as a set of uniformly spread steered signals. In practice, it has been found to be advantageous to modify the DesiredDiffuseISSI and DesiredDiffuseOSSI matrices based on subjective assessment such as, for instance, in response to the subjective loudness of the steered signals.

As an example, one choice of DesiredDiffuseISSI and DesiredDiffuseOSSI is the following:

$$DesiredDiffuseISSI = \begin{bmatrix} 1/2 & 0 \\ 0 & 1/2 \end{bmatrix} \tag{1.45}$$

$$DesiredDiffuseOSSI = \begin{bmatrix} 0.370 & 0.000 \\ 0.262 & 0.262 \\ 0.000 & 0.370 \\ 0.380 & -0.085 \\ -0.085 & 0.380 \end{bmatrix} \tag{1.46}$$

Calculation of the Mixing Matrix, M

The final step in the decoder is to compute the coefficients of the mix matrix M. In theory, M is intended to be a least-mean-squares solution to the equation:

$$M \times \text{ISSI} = \text{OSSI} \tag{1.47}$$

In practice, the ISSI matrix is always positive-definite. This therefore yields two possible methods for efficiently calculating M.

Being positive-definite, ISSI is invertible. So, it is possible to compute M by the equation: $M = \text{ISSI} \times \text{OSSI}^{-1}$.

Because ISSI is positive-definite, it is fairly straightforward to compute M iteratively, using a gradient descent algorithm. The gradient-descent method may operate as follows:

$$M_{i+1} = M_i + \delta \times (\text{OSSI} - M_i \times \text{ISSI}) \tag{1.48}$$

where δ is chosen so as to adjust the convergence rate of the gradient-descent algorithm. The value of δ may chosen deliberately small in order to slow down the update of M, thus smoothing time-variations in the mix coefficients and avoiding distortion artifacts that occur as a result of rapidly varying coefficients.

A Multiband Version of the Transformatter

The preceding has generally referred to the use of a single matrix, M, for processing the input signals to produce the output signals. This may be referred to as a Broadband Matrix because all frequency components of the input signal are processed in the same way. A multiband version, however, enables the decoder to apply other than the same matrix operations to different frequency bands.

Generally speaking, all multiband techniques may exhibit the following important features:

The input signals are broken into a number of bands, P, so that steering information may be inferred in band. The number P refers to the number of bands within which steering information is inferred or calculated.

The input-to-output processing operation is not a broadband mix, M, but instead varies over frequency, being roughly equivalent to a number of individual mix operations, B, each applied to a different frequency range. B refers to the number of frequency bands that are used in the processing of the output signals.

Figure 16:
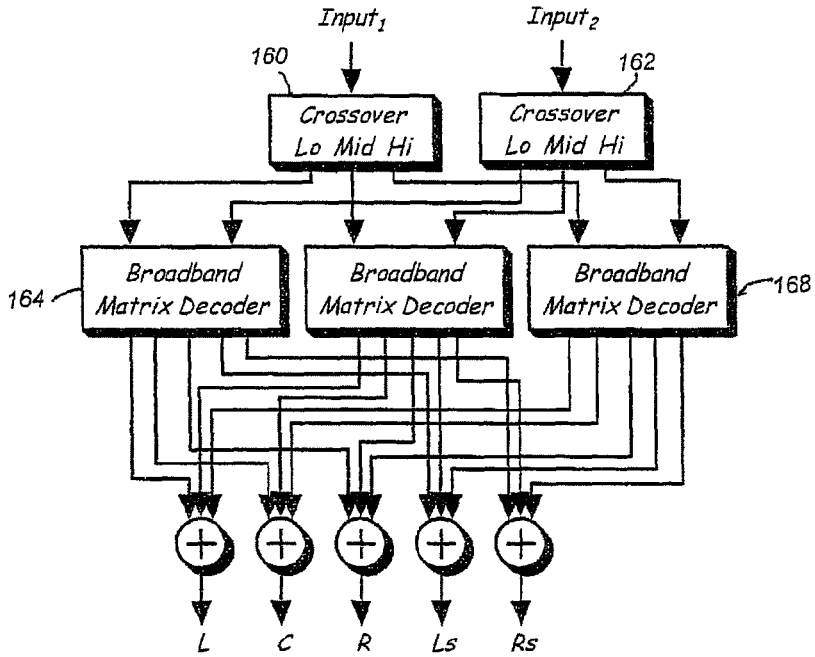
FIG. 16 is a functional block diagram showing an example of a multiband decoder in accordance with aspects of the present invention.

A multiband decoder may be implemented by splitting the input signals into a number of individual bands and then using a broadband matrix decoder on each band, as in the manner of the example of FIG. 16.

In this example, the input signals are split into three frequency bands. The "split" process may be implemented by using crossover filters or filtering processes ("Crossover") 160 and 162, as is used in loudspeaker crossovers. Crossover 160 receives a first input signal $\text{Input}_1$ and Crossover 162 receives a second input signal $\text{Input}_2$. The Low-, Mid-, and High-frequency signals derived from the two inputs are then fed into three broadband matrix decoders or decoder functions ("Broadband Matrix Decoder") 164, 166 and 168, respectively, and the outputs of the three decoders are then summed back together by additive combiners or combining functions (shown, respectively, symbolically each with a "plus" symbol) to produce the final five output channels (L,C, R,Ls,Rs).

Each of the three broadband decoders 164, 166, and 168 operates on a different frequency band and each is therefore able to make a distinct decision regarding the dominant direction of panned audio within its respective frequency band. As a result, the multiband decoder may achieve a better result by decoding different frequency bands in different ways. For instance, a multiband decoder may be able to decode a matrix encoded recording of a tuba and a piccolo by steering the two instruments to different output channels, thereby taking advantage of their distinct frequency ranges.

In the example of FIG. 16, three broadband decoders are effectively performing analysis on three frequency bands and subsequently processing the output audio on the same three frequency bands. Hence, in this example, P=B=3.

Figure 17:
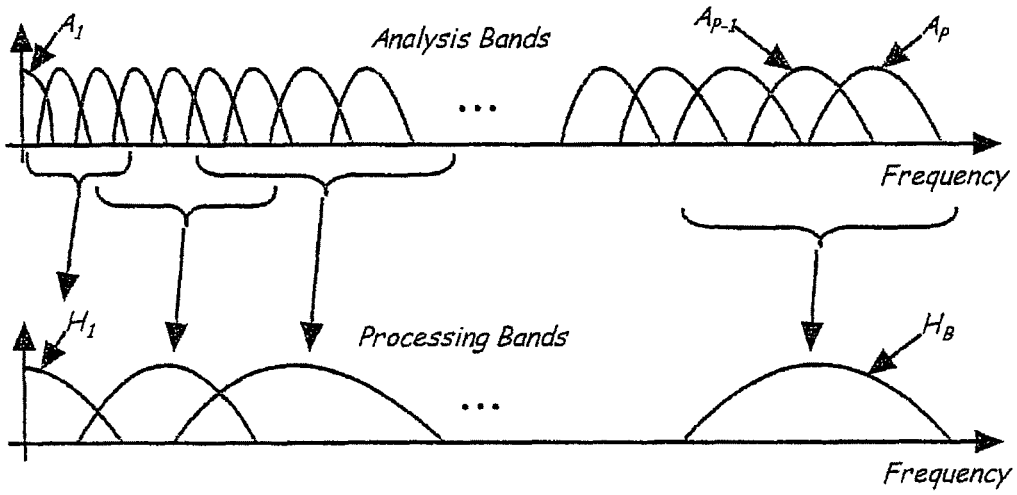
FIG. 17 is a notional presentation showing an example of merging a larger set of frequency bands into a smaller set by defining an appropriate mix matrix $M_b$ for each output processing band.

An aspect of the present invention is the ability of a Transformatter to operate when P>B. That is, when (P) of channels of steering information is derived (PartialISSI statistical extraction) and the output processing is applied to smaller number (B) of broader frequency bands, aspects of the present invention defines the way in which the larger set is merged into the smaller set by defining the appropriate mix matrix $M_b$ for each output processing band. This situation is shown in the example of FIG. 17. Each of the output processing bands ($H_b$: b=1 . . . B) overlaps with a respective set of input analysis bands, as indicated by the grouping braces in the figure.

In order to operate on P analysis bands and subsequently process the audio on B processing bands, a multiband version of the Transformatter begins by computing the P AnalysisData sets as is next described. This may be compared with the upper half of FIG. 16. The AnalysisData represents the set of data for one analysis band. For each output band, b=1 . . . B, the AnalysisData is combined as follows (compare to Equations (1.35), (1.36), (1.43) and (1.46)):

$$\text{FinalISSI}(b)=\text{ISSI}_{diff}(b)+\text{ISSI}_{steered}(b)$$

$$\text{FinalOSSI}(b)=\text{OSSI}_{diff}(b)+\text{OSSI}_{steered}(b) \tag{1.49}$$

where $$ISSI_{steered}(b)=\sum_p (BandWeight_{b,p}\times ISSI_{steered,p}) \tag{1.50}$$

$$OSSI_{steered}(b)\equiv\sum_p (BandWeight_{b,p}\times OSSI_{steered,p})$$

and $$ISSI_{diff}(b)=\left(\sum_p BandWeight_{b,p}\times\sigma^2_{noise,p}\right)\times DesiredDiffuseISSI(b) \tag{1.51}$$

$$OSSI_{diff}(b)=\left(\sum_p BandWeight_{b,p}\times\sigma^2_{noise,p}\right)\times DesiredDiffuseOSSI(b)$$

Finally, $$M_b=FinalOSSI(b)\times FinalISSI(b)^{-1} \tag{1.52}$$

The above calculations are identical to those for the broadband decoder, except that the M matrix, and the FinalISSI and FinalOSSI matrices, are computed for each processing band (b=1 . . . B), and the PartialISSI AnalysisData ($ISSI_{S,p}$, $OSSI_{S,p}$ and $\sigma_p$) is weighted by $BandWeight_{b,p}$. The weighting factors are used so that the each of the output processing bands is only affected by the AnalysisData from overlapping analysis bands.

Each output processing band (b) may overlap with a small number of input analysis bands. Therefore, many of the $BandWeight_{b,p}$ weights may be zero. The sparseness of the BandWeights data may be used to reduce the number of terms required in the summation operations shown in Equations (1.50) and (1.51).

Figure 18:
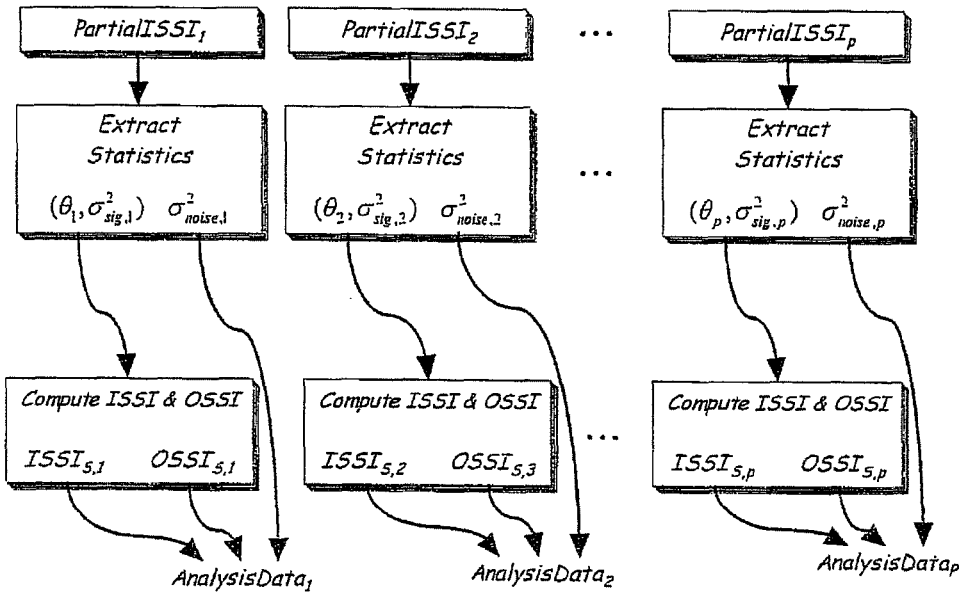
FIG. 18 shows conceptually an example of calculating analysis band data in a multiband decoder according to aspects of the present invention.

Once the $M_b$ matrices have been computed (for b=1 . . . B), the output signal may be computed by a number of different techniques:

The input signals may be split into B bands, and each band (b) may be processed through its respective matrix $M_b$ to produce NO output channels. In this case, B×NO intermediate signals are generated. The B sets of NO output channels may be subsequently summed back together to produce NO wideband output signals. This technique is very similar to that shown in FIG. 18.

The input signals may be mixed together in the frequency domain. In this case, the mixing coefficients may be varied as a smooth function of frequency. For example, the mixing coefficients for intermediate FFT bins may be computed by interpolating between the coefficients of matrices $M_b$ and $M_{b+1}$, assuming that the FFT bin corresponds to a frequency that lies between the center frequency of processing bands b and b+1.

Implementation

The invention may be implemented in hardware or software, or a combination of both (e.g., programmable logic arrays). Unless otherwise specified, the algorithms included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to pedal in the procedures described herein. The inventive system may also be considered to be implemented as a computer-readable storage medium, configured with a computer program, where the storage medium so configured causes a computer system to operate in a specific and predefined manner to perform the functions described herein. A number of embodiments of the invention have been described. Nevertheless, it will be understood that various modifications may be made without departing from the spirit and scope of the invention. For example, some of the steps described herein may be order independent, and thus can be performed in an order different from that described.

I claim:

1. A method for reformatting a plurality [NI] of audio input signals [$Input_1(t)$ . . . $Input_{N1}(t)$] from a first format to a second format by applying them to a dynamically-varying transformatting matrix [M], in which the plurality of audio input signals are assumed to have been derived by applying a plurality of notional source signals [$Source_1(t)$ . . . $Source_{NS}(t)$], each associated with information about itself, to an encoding matrix [1], the encoding matrix processing the notional source signals in accordance with a first rule that processes each notional source signal in accordance with the notional information associated with it, the transformatting matrix being controlled so that differences are reduced between a plurality [NO] of output signals [$Output_1(t)$ . . . $Output_{NO}(t)$] produced by it and a plurality [NO] of notional ideal output signals [$IdealOut_1(t)$ . . . $IdealOut_{NO}(t)$] assumed to have been derived by applying the notional source signals to an ideal decoding matrix [O], the decoding matrix processing the notional source signals in accordance with a second rule that processes each notional source signal in accordance with the notional information associated with it, comprising obtaining, in response to the audio input signals in each of a plurality of frequency and time segments, information attributable to the direction and intensity of one or more directional signal components and to the intensity of a diffuse, non-directional signal component, calculating the transformatting matrix based on the first and second rules, said calculating including (a) estimating (i) a covariance matrix of the audio input signals in at least one of said plurality of frequency and time segments and (ii) a cross-covariance matrix of the audio input signals and the notional ideal output signals in the same at least one of said plurality of frequency and time segments, and (b) combining, in a plurality of said frequency and time segments, (i) said directions and intensities of dominant signal components and (ii) said intensities of diffuse, non-directional signal components, and applying the audio input signals to the transformatting matrix to produce said output signals.

2. A method for reformatting a plurality [NI] of audio input signals [$Input_1(t)$ . . .

$Input_{N1}(t)$] from a first format to a second format by applying them to a dynamically-varying transformatting matrix [M], in which the plurality of audio input signals are assumed to have been derived by applying a plurality of notional source signals [$Source_1(t)$ . . . $Source_{Ns}(t)$], each assumed to be mutually uncorrelated with one another and each associated with information about itself, to an encoding matrix [I], the encoding matrix processing the notional source signals in accordance with a first rule that processes each notional source signal in accordance with the notional information associated with it, the transformatting matrix being controlled so that differences are reduced between a plurality [NO] of output signals [$Output_1(t)$ . . . $Output_{NO}(t)$] produced by it and a plurality [NO] of notional ideal output signals [$IdealOut_1(t)$ . . . $IdealOut_{NO}(t)$] assumed to have been derived by applying the notional source signals to an ideal decoding matrix [O], the decoding matrix processing the notional source signals in accordance with a second rule that processes each notional source signal in accordance with the notional information associated with it, comprising obtaining, in response to the audio input signals in each of a plurality of frequency and time segments, information attributable to the direction and intensity of one or more directional signal components and to the intensity of a diffuse, non-directional signal component, calculating the transformatting matrix M, said calculating including (a) combining, in a plurality of said frequency and time segments, (i) said directions and intensities of dominant signal components and (ii) said intensities of diffuse, non-directional signal components, the result of said combining constituting an estimate of a covariance matrix of said source signals, and (b) calculating $M=(O\times[cov(Source)]\times I^*)\times(I\times[cov(Source)]\times I^*)^{-1}$, and applying the audio input signals to the transformatting matrix to produce said output signals.

3. A method according to claim 1 or claim 2 wherein said notional information comprises an index and the processing in accordance with a first rule associated with a particular index is paired with the processing in accordance with a second rule associated with the same index.

4. A method according to claim 3 wherein the notional information is notional directional information.

5. A method according to claim 4 wherein the notional directional information is notional three-dimensional directional information.

6. A method according to claim 5 wherein the notional three-dimensional directional information includes a notional azimuthal and elevation relationship with respect to a notional listening position.

7. A method according to claim 4 wherein the notional directional information is notional two-dimensional directional information.

8. A method according to claim 7 wherein the notional two-dimensional directional information includes a notional azimuthal relationship with respect to a notional listening position.

9. A method according to claim 1 or claim 2 wherein said first rules are input panning rules and said second rules are output panning rules.

10. A method according to claim 1 or claim 2 wherein said obtaining includes calculating a covariance matrix of the audio input signals in said each of said plurality of frequency and time segments.

11. A method according to claim 10 wherein said direction and intensity of one or more dominant signal components and intensity of a diffuse, non-directional signal component for each frequency and time segment is estimated, based on the results of said covariance matrix calculation.

12. A method according to claim 11 wherein the estimate of the diffues, non-directional signal component for each frequency and time segment is formed from the value of the smallest eigenvalue in the covariance matrix calculation.

13. A method according to claim 1 wherein the transformatting matrix characteristics are calculated as a function of said covariance matrix and said cross-covariance matrix.

14. A method according to claim 13 wherein the elements of the transformatting matrix [M] are obtained by operating on the cross-covariance matrix from the right by the inverse of the covariance matrix, $$M=Cov([IdealOutput],\ [Input])\ \{Cov([Input],\ [Input])\}^{-1}.$$

15. A method according to claim 14 wherein said plurality of notional source signals are assumed to be mutually uncorrelated with respect to each other, whereby a covariance matrix of the notional source signals, the calculation of which is inherent in the calculation of M, is diagonalized, thereby simplifying the calculations.

16. A method according to claim 14 wherein the decoder matrix [M] is determined by a method of steepest descent.

17. A method according to claim 16 wherein the method of steepest descent is a gradient descent method that computes an iterated estimate of the transformatting matrix based on a previous estimate of M from a prior time interval.

18. A method according to claim 1 or claim 2 wherein said decoder matrix [M] is a weighted sum of frequency-dependent decoder matrices $[M_B]$, $$M=\Sigma_B W_B M_B$$

wherein $W_B$ denotes weight coefficients and wherein said frequency dependence is associated with a bandwidth B.

19. An active audio decoding method according to claim 3 in which said first and second rules are implemented as first and second lookup tables, table entries being paired with one another by a common index.

20. An Apparatus comprising a processor adapted to practice the method of claim 1 or claim 2.

21. A non-transitory computer program product comprising a computer program adapted to implement the method of claim 1 or claim 2.

* * * * *